US011291277B1

(12) United States Patent
Tashjian

(10) Patent No.: US 11,291,277 B1
(45) Date of Patent: Apr. 5, 2022

(54) LINES, EARRINGS WITH SUCH LINES, AND METHODS OF MANUFACTURE AND USE THEREOF

(71) Applicant: Venus by Maria Tash, Inc., New York, NY (US)

(72) Inventor: Maria Tashjian, New York, NY (US)

(73) Assignee: Venus by Maria Tash, Inc., New York, NY (US)

( * ) Notice: Subject to any disclaimer, the term of this patent is extended or adjusted under 35 U.S.C. 154(b) by 0 days.

(21) Appl. No.: 17/239,419

(22) Filed: Apr. 23, 2021

(51) Int. Cl.
*A44C 13/00* (2006.01)
*A44C 25/00* (2006.01)
*A44C 7/00* (2006.01)

(52) U.S. Cl.
CPC ..... *A44C 7/002* (2013.01)

(58) Field of Classification Search
CPC ..... A44C 7/00; A44C 13/00; A44C 15/001; A44C 15/003; A44C 7/002; A44C 15/0055
See application file for complete search history.

(56) References Cited

U.S. PATENT DOCUMENTS

| | | | | |
|---|---|---|---|---|
| 1,556,106 | A * | 10/1925 | Hamilton | A44C 15/0055 63/1.11 |
| D292,543 | S | 11/1987 | Smith | D3/100 |
| 4,783,974 | A * | 11/1988 | Hernandez | A44C 7/002 63/1.16 |
| D335,473 | S | 5/1993 | Sprick | D11/213 |
| 5,675,988 | A | 10/1997 | Ignatowski | |
| D567,704 | S | 4/2008 | Martin | D11/87 |
| D631,775 | S | 2/2011 | Marchand | D11/3 |
| D778,256 | S | 2/2017 | Jung | D14/205 |
| D800,012 | S | 10/2017 | Oliner-Katz | D11/43 |
| 2004/0200236 | A1 | 10/2004 | Emberson et al. | |

FOREIGN PATENT DOCUMENTS

| | | | | |
|---|---|---|---|---|
| CN | 304932709 | | 12/2018 | 11/1 |
| CN | 305316050 | | 8/2019 | 11/1 |
| DE | 3014135 | A1 * | 10/1981 | A44C 15/0055 |
| DE | 10059544 | A1 * | 5/2003 | A44C 15/0055 |
| DE | 402014100168-0045 | | 6/2014 | 11/1 |
| EP | 1232701 | A2 * | 8/2002 | A44C 15/0055 |
| EP | 2227976 | A1 * | 9/2010 | A44C 15/0055 |
| FR | 975647-004 | | 1/1998 | 11/1 |
| FR | 045172-001 | | 7/2005 | 11/1 |

(Continued)

OTHER PUBLICATIONS

DHGate Store, Bead Face Mask Strap Glasses Lanyard Eyewear Retainer Sunglass Straps Eyeglass Holder Anti-lost Rope Safety Glasses lanyards 70cm KHA699, downloaded from internet Feb. 25, 2021, https://www.dhgate.com/product/bead-face-mask-strap-glasses-lanyard-eyewear/583520820.html (10 pages).

(Continued)

*Primary Examiner* — Jack W Lavinder
(74) *Attorney, Agent, or Firm* — Dentons US LLP

(57) ABSTRACT

This disclosure enables various lines, earrings with such lines, and methods of manufacture and use thereof. For example, some of these lines may extend between a pair of earrings worn on a pair of ears of a wearer. This form of extension may be arcuate, parabolic, hyperbolic, or gravitational.

30 Claims, 25 Drawing Sheets

(56) References Cited

FOREIGN PATENT DOCUMENTS

| | | | | | |
|---|---|---|---|---|---|
| GB | 221673 | A * | 9/1924 | ..... | A44C 15/0055 |
| GB | 4004099 | | 9/2007 | ..... | 11/1 |
| GB | 6018033 | | 9/2017 | ..... | 11/1 |
| JP | D1218667 | | 9/2004 | ..... | 16/6 |
| KR | 20140036075 | A * | 3/2014 | | |
| KR | 3020190001068 | | 8/2019 | ..... | 14/1 |
| KR | 301090582.0000 | | 1/2021 | ..... | 2/3 |
| TR | 636700-0001 | | 1/2010 | ..... | 11/1 |
| TR | 201402053-0007 | | 5/2014 | ..... | 11/1 |
| WO | WO-9602159 | A1 * | 2/1996 | ..... | A44C 15/0055 |

OTHER PUBLICATIONS

DIY Jewelry Hub, Learn how to make jewelry, downloaded from internet Feb. 25, 2021, http://www.diyiewelryhub.com/tag/how-to-make-a-bracelet/#sthash.OVGD9llx.dpbs (105 pages).

Schindel, How to Make a Convertible Beaded Mask or Eyeglass Holder and Necklace, Nov. 2020, https://feltmagnet.com/crafts/beaded-convertible-eyeglasses-leash-necklace (14 pages).

Totaram Jewelers, Dori—Tassels, downloaded from internet Apr. 23, 2021, https://www.totaram.com/22k-gold-jewelry/gold-accessories/dori-tassels-for-necklaces-pendants.html (5 pages).

WhereToGet, Best Tips, downloaded from internet Apr. 23, 2021, https://wheretoget.com/look/265883 (3 pages).

* cited by examiner

LINES, EARRINGS WITH SUCH LINES, AND METHODS OF MANUFACTURE AND USE THEREOF

TECHNICAL FIELD

This disclosure relates to lines, earrings with such lines, and methods of manufacture and use thereof.

BACKGROUND

A person often desires to wear different pairs of earrings for different occasions. For example, the person may wear a first pair of earrings with a first aesthetic appearance to a first event (e.g., a professional conference) and a second pair of earrings with a second aesthetic appearance, different from the first aesthetic appearance, to a second event (e.g., a personal party). However, such desire may be difficult to attain, especially without taking off the first pair of earrings. For example, the person may have nowhere to carry another pair of earrings, the person may have forgotten the second pair of earrings at home, the person may have lost or broke the second pair of earrings before the second event, the person may not want to remove the first pair of earrings to insert the second pair of earrings, the person may not be able to afford the second pair of earrings, or other reasons.

If the person wears a facial covering (e.g., a surgical mask, a facial shield, a gaiter, a scarf, a ski mask, a balaclava) or a head covering (e.g., a hijab, a turban, a headscarf, a veil, a beanie, a knit cap) over or in proximity of the first pair of earrings, then switching from the first pair of earrings to the second pair of earrings may become more burdensome, laborious, undesired, and time-consuming. This is so because the facial covering or the head covering may be interfering with this switch. Therefore, the person may undesirably need to substantially adjust or remove the facial covering or the head covering in order to switch from the first pair of earrings to the second pair of earrings.

If the person wearing the facial covering or the head covering desires to switch back from the second pair of earrings to the first pair of earrings (e.g., when the person does not like how the second pair of earrings appears when worn on the person or the second pair of earrings broke after the person put on the second pair of earrings), then this process may undesirably be repeated. Such repetition is further burdensome, laborious, undesired, and time-consuming.

SUMMARY

Generally, this disclosure enables various lines (e.g., a necklace, a chain, a braid, a rope, a string, a cable), earrings with such lines, and methods of manufacture and use thereof.

For example, some of these lines may extend (e.g., span) between a pair of earrings (e.g., with a post, a clip-on) worn on a pair of ears of a wearer (e.g., a person, a showcase head, a mannequin). This form of extension may be arcuate, parabolic, hyperbolic, or gravitational, whether the line is flexible, bendable, rigid, or of another form, whether the line is extended for aesthetic purposes (e.g., to function as a necklace) or for utilitarian purposes (e.g., to hold or suspend an object thereon). As such, if the wearer is wearing a facial covering (e.g., a surgical mask, a facial shield, a gaiter, a scarf, a ski mask, a balaclava) or a head covering (e.g., a hijab, a turban, a headscarf, a veil, a beanie, a knit cap) over or in proximity of the pair of ears, then some of these lines may be worn, without substantially adjusting or removing the facial covering or the head covering.

For example, some of these lines may be selectively secured (e.g., detachably attached, attachably detached, mounted, clasped, connected, fastened, mated, interlocked, magnetized, latched, grasped, hooked, hook-and-looped) to the pair of earrings, whether the pair of earrings is being worn on the pair of ears, without taking off the pair of earrings from the pair of ears, or whether the pair of earrings is not being worn on the pair of ears.

For example, if the wearer is wearing the pair of earrings and the facial covering or the head covering over or in proximity of the pair of earrings, then some of these lines may be selectively secured to the pair of earrings, while the pair of earrings is worn on the pair of ears, without taking off the pair of earrings from the pair of ears or without substantially adjusting or removing the facial covering or the head covering.

For example, some of these lines may include a line having a first end portion and a second end portion. The first end portion may include a first connector (e.g., a jump ring, a clasp, a magnet, a fastener, a latch, a hook, a mating interface, a frontal piece of an earring, a post of an earring, a backing of an earring, a clip-on wing of an earring) and the second end portion may include a second connector (e.g., a jump ring, a clasp, a magnet, a fastener, a latch, a hook, a mating interface, a frontal piece of an earring, a post of an earring, a backing of an earring, a clip-on wing of an earring), whether the first connector is identical or not identical to the second connector in terms of structure, properties (e.g., geometry, materials), or modality of operation. The first connector may be selectively secured (e.g., detachably attached, attachably detached, mounted, clasped, connected, fastened, mated, interlocked, magnetized, latched, grasped, hooked, hook-and-looped) to a first earring (e.g., a frontal piece, a post, a backing, a clip-on wing) worn on a first ear (e.g., a lobe, a conch, a helix) of the wearer and the second connector may be selectively secured (e.g., detachably attached, attachably detached, mounted, clasped, connected, fastened, mated, interlocked, magnetized, latched, grasped, hooked, hook-and-looped) to a second earring (e.g., a frontal piece, a post, a backing, a clip-on wing) worn on a second ear (e.g., a lobe, a conch, a helix) of the wearer, independent of the first connector. Note that any forms of such selective securement (e.g., detachably attached, attachably detached, mounted, clasped, connected, fastened, mated, interlocked, magnetized, latched, grasped, hooked, hook-and-looped) may include a selective unsecurement, which may occur via a reversal of such selective securement. Regardless, this configuration may have various technological benefits. For example, this configuration may be helpful if the line needs to be switched to another line, which may occur without removing the pair of earrings from the pair of ears. Likewise, this configuration may be helpful when the line needs to be extended in length, which may occur without removing the pair of earrings from the pair of ears. Similarly, this configuration may be helpful when multiple lines are desired to extend between the pair of earrings, which may occur without removing the pair of earrings from the pair of ears. Additionally, this configuration may be helpful when the wearer is wearing the facial covering, the head covering, or another object (e.g., a garment, a jewelry item, a necklace, a prosthetic, a neck brace, a hat, a turtleneck, a scarf, a jacket, a set of over-an-ear headphones, a stethoscope), which may interfere with the line being decoratively or non-decoratively worn on the wearer while the line extends between the pair of earrings worn on the pair of ears. Therefore, the wearer may change its aesthetic appearance or selectively secure/unsecure (e.g., mount, loop, magnetize, fasten, mate) an object (e.g., a pendant, a charm, a housing of an electronic device) to or from the line quickly and easily, which can occur without taking off the pair of earrings from the pair of ears. For example, the wearer may change its aesthetic appearance for (a) different occasions (e.g., a professional conference and a birthday party) or (b) matching with different items of clothing, without taking off the pair of earrings from the pair of ears.

Note that although the line may be selectively secured (e.g., detachably attached, attachably detached, mounted, clasped, connected, fastened, mated, interlocked, magnetized, latched, grasped, hooked, hook-and-looped) to and selectively unsecured (reversing selective securement) from the pair of earrings, this is not required. For example, the line can be permanently secured (e.g., welded, soldered, molded, chiseled, 3D printed) to the pair of earrings (e.g., inoperative or broken when unsecured).

In an embodiment, a method comprising: causing a first end portion of a line to extend from a first earring worn on a first ear of a wearer; and causing a second end portion of the line to extend from a second earring worn on a second ear of the wearer such that the line arcuately, parabolically, hyperbolically, or gravitationally spans between the first ear and the second ear.

In an embodiment, a method comprising: extending a first end portion of a line from a first earring worn on a first ear of a wearer; and extending a second end portion of the line from a second earring worn on a second ear of the wearer such that the line arcuately, parabolically, hyperbolically, or gravitationally spans between the first earring and the second earring.

In an embodiment, a kit comprising: a first earring configured to be worn on a first ear of a wearer; a second earring configured to be worn on a second ear of the wearer; and a line including a first end portion and a second end portion, wherein the first end portion is configured to be selectively secured to the first earring when the first earring is worn on the first ear and the second end portion is configured to be selectively secured to the second earring when the second earring is worn on the second ear such that the line arcuately, parabolically, hyperbolically, or gravitationally spans between the first earring and the second earring.

In an embodiment, a device comprising: a first earring configured to be worn on a first ear of a wearer; a second earring configured to be worn on a second ear of the wearer; and a line including a first end portion and a second end portion, wherein the first end portion extends from the first earring when the first earring is worn on the first ear and the second end portion extends from the second earring when the second earring is worn on the second ear such that the line arcuately, parabolically, hyperbolically, or gravitationally spans between the first earring and the second earring.

In an embodiment, a method comprising: causing a first end portion of a line to extend from a first earring worn on a first ear of a wearer and covered by a facial covering of the wearer or a head covering of the wearer; causing a second end portion of the line to extend from a second earring worn on a second ear of the wearer and covered by the facial covering or the head covering; and causing the line to extend out of and over the facial covering or the head covering underneath a chin of the wearer such that (1) the line arcuately, parabolically, hyperbolically, or gravitationally spans between the first earring and the second earring underneath the chin, and (2) the line is visible when frontally observing a face of the wearer.

In an embodiment, a method comprising: extending a first end portion of a line from a first earring worn on a first ear of a wearer and covered by a facial covering of the wearer or a head covering of the wearer; extending a second end portion of the line from a second earring worn on a second ear of the wearer and covered by the facial covering or the head covering; and extending the line out of and over the facial covering or the head covering underneath a chin of the wearer such that (1) the line arcuately, parabolically, hyperbolically, or gravitationally spans between the first earring and the second earring underneath the chin, and (2) the line is visible when frontally observing a face of the wearer.

In an embodiment, a method comprising: causing a first end portion of a first elongated portion to extend from a first earring worn on a first ear of a wearer, wherein the first elongated portion includes a second end portion; causing a third end portion of a second elongated portion to extend from a second earring worn on a second ear of the wearer, wherein the second elongated portion includes a fourth end portion; and causing the second end portion and the fourth end portion to be selectively secured to each other such that a line that spans arcuately, parabolically, hyperbolically, or gravitationally between the first earring and the second earring is formed.

In an embodiment, a method comprising: causing a first end portion of a first elongated portion to extend from a first earring worn on a first ear of a wearer, wherein the first elongated portion includes a second end portion; causing a third end portion of a second elongated portion to extend from a second earring worn on a second ear of the wearer, wherein the second elongated portion includes a fourth end portion; and causing the second end portion and the fourth end portion to be selectively secured to each other such that a line that spans arcuately, parabolically, hyperbolically, or gravitationally between the first earring and the second earring is formed.

In an embodiment, a method comprising: causing a first end portion of a line to extend from a first earring worn on a first ear of a wearer and a second end portion of the line to extend from a second earring worn on a second ear of the wearer such that the line spans arcuately, parabolically, hyperbolically, or gravitationally between the first earring and the second earring, wherein the line includes a first elongated portion and a second elongated portion, wherein the first elongated portion includes the first end portion and a third end portion, wherein the second elongated portion includes the second end portion and a fourth end portion, wherein the third end portion and the fourth end portion are selectively secured to each other between (1) the first earring and the second earring and (2) the first end portion and the second end portion; and unsecuring selectively the third end portion and the fourth end portion from each other such that the line does not span arcuately, parabolically, hyperbolically, or gravitationally between the first earring worn on the first ear and the second earring worn on the second ear.

In an embodiment, a kit comprising: a first earring configured to be worn on a first ear of a wearer; a second earring configured to be worn on a second ear of the wearer; a first elongated portion including a first end portion and a second end portion, wherein the first end portion is configured to selectively secure to the first earring; and a second elongated portion including a third end portion and a fourth end portion, wherein the third end portion is configured to selectively secure to the second earring, wherein the second end portion and the fourth end portion are configured to selectively secure to each other such that a line is formed by the first elongated portion and the second elongated portion when the first end portion is selectively secured to the first earring worn on the first ear and the third end portion is selectively secured to the second earring worn on the second ear and the line spans arcuately, parabolically, hyperbolically, or gravitationally between the first earring worn on the first ear and the second earring worn on the second ear.

In an embodiment, a kit comprising: a first earring configured to be worn on a first ear of a wearer, wherein the first earring includes a first elongated portion extending therefrom, wherein the first elongated portion includes a first end portion distal to the first earring; and a second earring configured to be worn on a second ear of the wearer, wherein the second earring includes a second elongated portion extending therefrom, wherein the second elongated portion includes a second end portion distal to the second earring, wherein the first end portion and the second end portion are configured to selectively secure to each other when the first earring is worn on the first ear and the second earring is worn on the second ear such that a line is formed by the first elongated portion and the second elongated portion and the line spans arcuately, parabolically, hyperbolically, or gravitationally between the first earring worn on the first ear and the second earring worn on the second ear.

In an embodiment, a device comprising: a first earring worn on a first ear of a wearer; a second earring worn on a second ear of the wearer; and a line including a first end portion and a second end portion, wherein the first end portion extends from the first earring and the second end portion extends from the second earring such that the line arcuately, parabolically, hyperbolically, or gravitationally spans between the first earring and the second earring.

DETAILED DESCRIPTION

Figure 1:
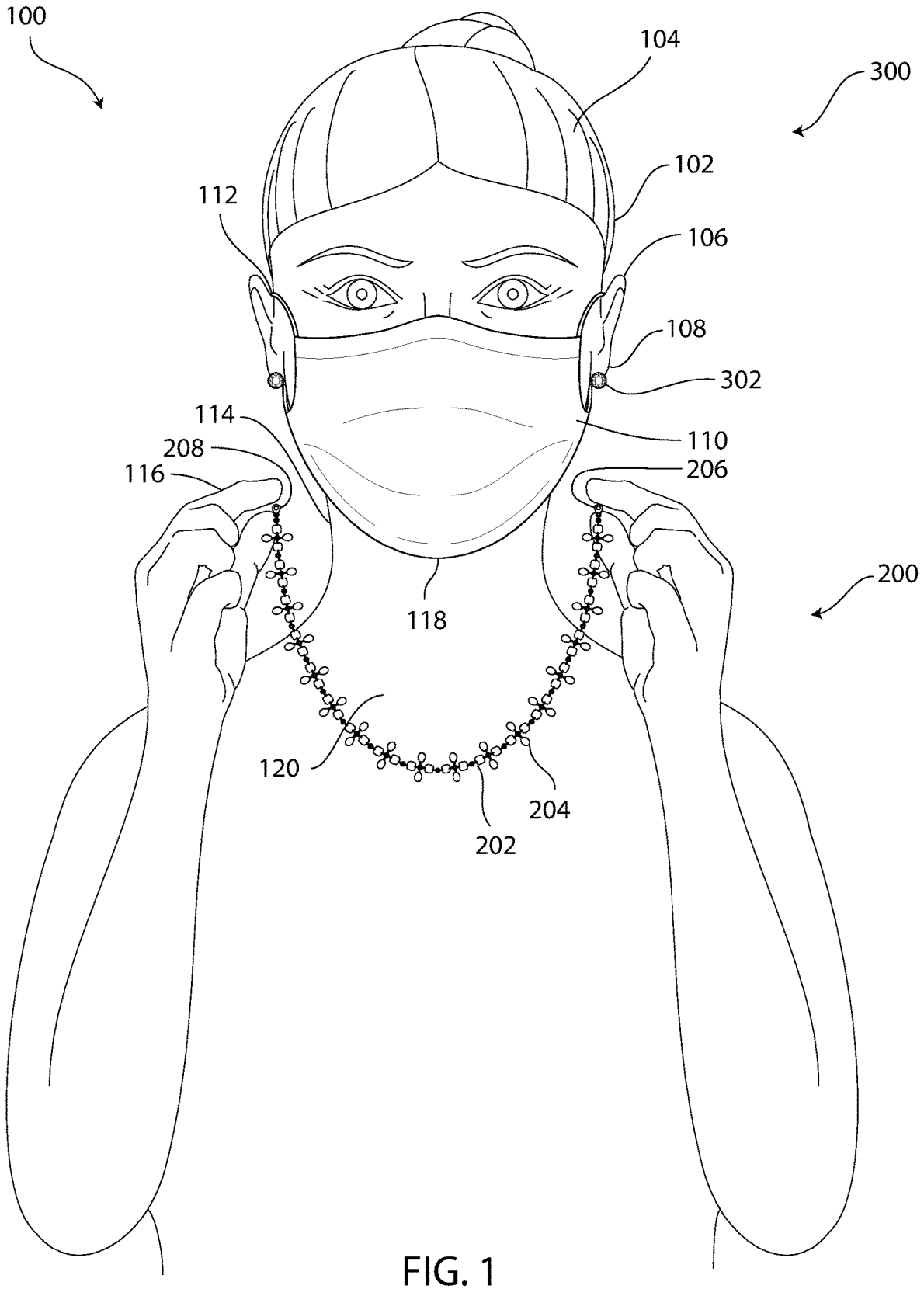
FIG. 1 illustrates an embodiment of a line before selective securement of the line to a pair of earrings worn on a pair of ears of a wearer according to various principles of this disclosure.

Generally, this disclosure enables various lines (e.g., a necklace, a chain, a braid, a rope, a string, a cable), earrings with such lines, and methods of manufacture and use thereof.

For example, some of these lines may extend (e.g., span) between a pair of earrings (e.g., with a post, a clip-on) worn on a pair of ears of a wearer (e.g., a person, a showcase head, a mannequin). This form of extension may be arcuate, parabolic, hyperbolic, or gravitational, whether the line is flexible, bendable, rigid, or of another form, whether the line is extended for aesthetic purposes (e.g., to function as a necklace) or for utilitarian purposes (e.g., to hold or suspend an object thereon). As such, if the wearer is wearing a facial covering (e.g., a surgical mask, a facial shield, a gaiter, a scarf, a ski mask, a balaclava) or a head covering (e.g., a hijab, a turban, a headscarf, a veil, a beanie, a knit cap) over or in proximity of the pair of ears, then some of these lines may be worn, without substantially adjusting or removing the facial covering or the head covering.

For example, some of these lines may be selectively secured (e.g., detachably attached, attachably detached, mounted, clasped, connected, fastened, mated, interlocked, magnetized, latched, grasped, hooked, hook-and-looped) to the pair of earrings, whether the pair of earrings is being worn on the pair of ears, without taking off the pair of earrings from the pair of ears, or whether the pair of earrings is not being worn on the pair of ears.

For example, if the wearer is wearing the pair of earrings and the facial covering or the head covering over or in proximity of the pair of earrings, then some of these lines may be selectively secured to the pair of earrings, while the pair of earrings is worn on the pair of ears, without taking off the pair of earrings from the pair of ears or without substantially adjusting or removing the facial covering or the head covering.

For example, some of these lines may include a line having a first end portion and a second end portion. The first end portion may include a first connector (e.g., a jump ring, a clasp, a magnet, a fastener, a latch, a hook, a mating interface, a frontal piece of an earring, a post of an earring, a backing of an earring, a clip-on wing of an earring) and the second end portion may include a second connector (e.g., a jump ring, a clasp, a magnet, a fastener, a latch, a hook, a mating interface, a frontal piece of an earring, a post of an earring, a backing of an earring, a clip-on wing of an earring), whether the first connector is identical or not identical to the second connector in terms of structure, properties (e.g., geometry, materials), or modality of operation. The first connector may be selectively secured (e.g., detachably attached, attachably detached, mounted, clasped, connected, fastened, mated, interlocked, magnetized, latched, grasped, hooked, hook-and-looped) to a first earring (e.g., a frontal piece, a post, a backing, a clip-on wing) worn on a first ear (e.g., a lobe, a conch, a helix) of the wearer and the second connector may be selectively secured (e.g., detachably attached, attachably detached, mounted, clasped, connected, fastened, mated, interlocked, magnetized, latched, grasped, hooked, hook-and-looped) to a second earring (e.g., a frontal piece, a post, a backing, a clip-on wing) worn on a second ear (e.g., a lobe, a conch, a helix) of the wearer, independent of the first connector. Note that any forms of such selective securement (e.g., detachably attached, attachably detached, mounted, clasped, connected, fastened, mated, interlocked, magnetized, latched, grasped, hooked, hook-and-looped) may include a selective unsecurement, which may occur via a reversal of such selective securement. Regardless, this configuration may have various technological benefits. For example, this configuration may be helpful if the line needs to be switched to another line, which may occur without removing the pair of earrings from the pair of ears. Likewise, this configuration may be helpful when the line needs to be extended in length, which may occur without removing the pair of earrings from the pair of ears. Similarly, this configuration may be helpful when multiple lines are desired to extend between the pair of earrings, which may occur without removing the pair of earrings from the pair of ears. Additionally, this configuration may be helpful when the wearer is wearing the facial covering, the head covering, or another object (e.g., a garment, a jewelry item, a necklace, a prosthetic, a neck brace, a hat, a turtleneck, a scarf, a jacket, a set of over-an-ear headphones, a stethoscope), which may interfere with the line being decoratively or non-decoratively worn on the wearer while the line extends between the pair of earrings worn on the pair of ears. Therefore, the wearer may change its aesthetic appearance or selectively secure/unsecure (e.g., mount, loop, magnetize, fasten, mate) an object (e.g., a pendant, a charm, a housing of an electronic device) to or from the line quickly and easily, which can occur without taking off the pair of earrings from the pair of ears. For example, the wearer may change its aesthetic appearance for (a) different occasions (e.g., a professional conference and a birthday party) or (b) matching with different items of clothing, without taking off the pair of earrings from the pair of ears.

Note that although the line may be selectively secured (e.g., detachably attached, attachably detached, mounted, clasped, connected, fastened, mated, interlocked, magnetized, latched, grasped, hooked, hook-and-looped) to and selectively unsecured (reversing selective securement) from the pair of earrings, this is not required. For example, the line can be permanently secured (e.g., welded, soldered, molded, chiseled, 3D printed) to the pair of earrings (e.g., inoperative or broken when unsecured).

This disclosure may be embodied in many different forms and should not be construed as necessarily being limited to various embodiments disclosed herein. Rather, these embodiments are provided so that this disclosure is thorough and complete, and fully conveys various concepts of this disclosure to skilled artisans.

Various terminology used herein can imply direct or indirect, full or partial, temporary or permanent, action or inaction. For example, when an element is referred to as being "on," "connected," or "coupled" to another element, then the element can be directly on, connected, or coupled to another element or intervening elements can be present, including indirect or direct variants. In contrast, when an element is referred to as being "directly connected" or "directly coupled" to another element, then there are no intervening elements present.

As used herein, various singular forms "a," "an" and "the" are intended to include various plural forms (e.g., two, three, four, five, six, seven, eight, nine, ten, tens, hundreds, thousands) as well, unless specific context clearly indicates otherwise.

As used herein, various presence verbs "comprises," "includes" or "comprising," "including" when used in this specification, specify a presence of stated features, integers, steps, operations, elements, or components, but do not preclude the presence or addition of one or more other features, integers, steps, operations, elements, components, or groups thereof.

As used herein, a term "or" is intended to mean an inclusive "or" rather than an exclusive "or." That is, unless specified otherwise, or clear from context, "X employs A or B" is intended to mean any of a set of natural inclusive permutations. That is, if X employs A; X employs B; or X employs both A and B, then "X employs A or B" is satisfied under any of the foregoing instances.

As used herein, a term "or others," "combination", "combinatory," or "combinations thereof" refers to all permutations and combinations of listed items preceding that term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. Skilled artisans understand that typically there is no limit on number of items or terms in any combination, unless otherwise apparent from the context.

As used herein, unless otherwise defined, all terms (including technical and scientific terms) used herein have the same meaning as commonly understood by one of ordinary skill in an art to which this disclosure belongs. Various terms, such as those defined in commonly used dictionaries, should be interpreted as having a meaning that is consistent with a meaning in a context of a relevant art and should not be interpreted in an idealized or overly formal sense unless expressly so defined herein.

As used herein, relative terms such as "below," "lower," "above," and "upper" can be used herein to describe one element's relationship to another element as illustrated in the set of accompanying illustrative drawings. Such relative terms are intended to encompass different orientations of illustrated technologies in addition to an orientation depicted in the set of accompanying illustrative drawings. For example, if a device in the set of accompanying illustrative drawings were turned over, then various elements described as being on a "lower" side of other elements would then be oriented on "upper" sides of other elements. Similarly, if a device in one of illustrative figures were turned over, then various elements described as "below" or "beneath" other elements would then be oriented "above" other elements. Therefore, various example terms "below" and "lower" can encompass both an orientation of above and below.

As used herein, a term "about" or "substantially" refers to a +/−10% variation from a nominal value/term. Such variation is always included in any given value/term provided herein, whether or not such variation is specifically referred thereto.

Features described with respect to certain embodiments may be combined in or with various some embodiments in any permutational or combinatory manner. Different aspects or elements of example embodiments, as disclosed herein, may be combined in a similar manner.

Although various terms first, second, third, and so forth can be used herein to describe various elements, components, regions, layers, or sections, these elements, components, regions, layers, or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from various teachings of this disclosure.

Features described with respect to certain example embodiments can be combined and sub-combined in or with various other example embodiments. Also, different aspects or elements of example embodiments, as disclosed herein, can be combined and sub-combined in a similar manner as well. Further, some example embodiments, whether individually or collectively, can be components of a larger system, wherein other procedures can take precedence over or otherwise modify their application. Additionally, a number of steps can be required before, after, or concurrently with example embodiments, as disclosed herein. Note that any or all methods or processes, at least as disclosed herein, can be at least partially performed via at least one entity in any manner.

Example embodiments of this disclosure are described herein with reference to illustrations of idealized embodiments (and intermediate structures) of this disclosure. As such, variations from various illustrated shapes as a result, for example, of manufacturing techniques or tolerances, are to be expected. Thus, various example embodiments of this disclosure should not be construed as necessarily limited to various particular shapes of regions illustrated herein, but are to include deviations in shapes that result, for example, from manufacturing.

Any or all elements, as disclosed herein, can be formed from a same, structurally continuous piece, such as being unitary, or be separately manufactured or connected, such as being an assembly or modules. Any or all elements, as disclosed herein, can be manufactured via any manufacturing processes, whether additive manufacturing, subtractive manufacturing, or other any other types of manufacturing. For example, some manufacturing processes include three dimensional (3D) printing, laser cutting, computer numerical control routing, milling, pressing, stamping, vacuum forming, hydroforming, injection molding, lithography, and so forth.

Figure 2:
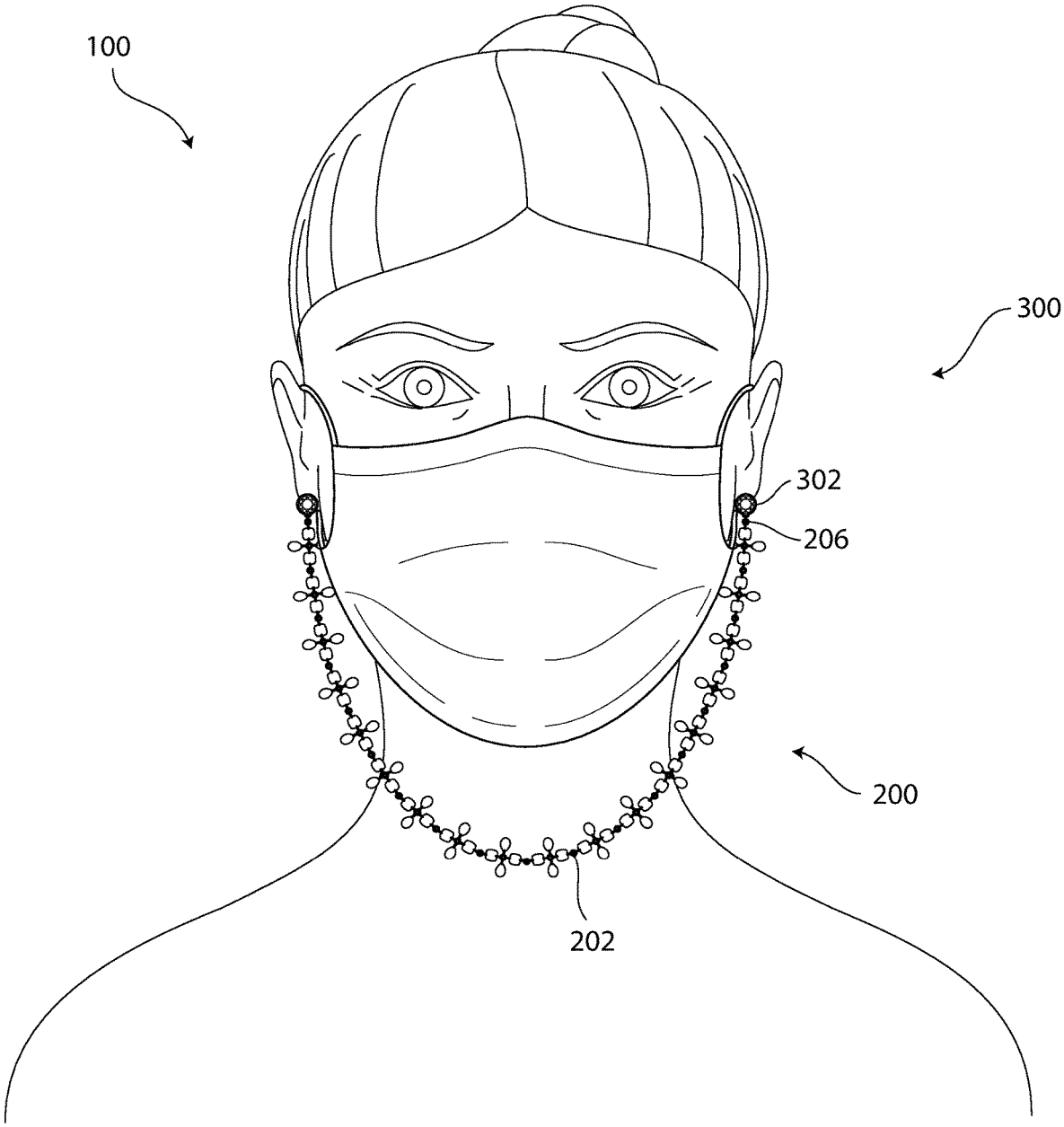
FIG. 2 illustrates an embodiment of a line after selective securement of the line to a pair of earrings worn on a pair of ears of a wearer according to various principles of this disclosure.
Figure 3:
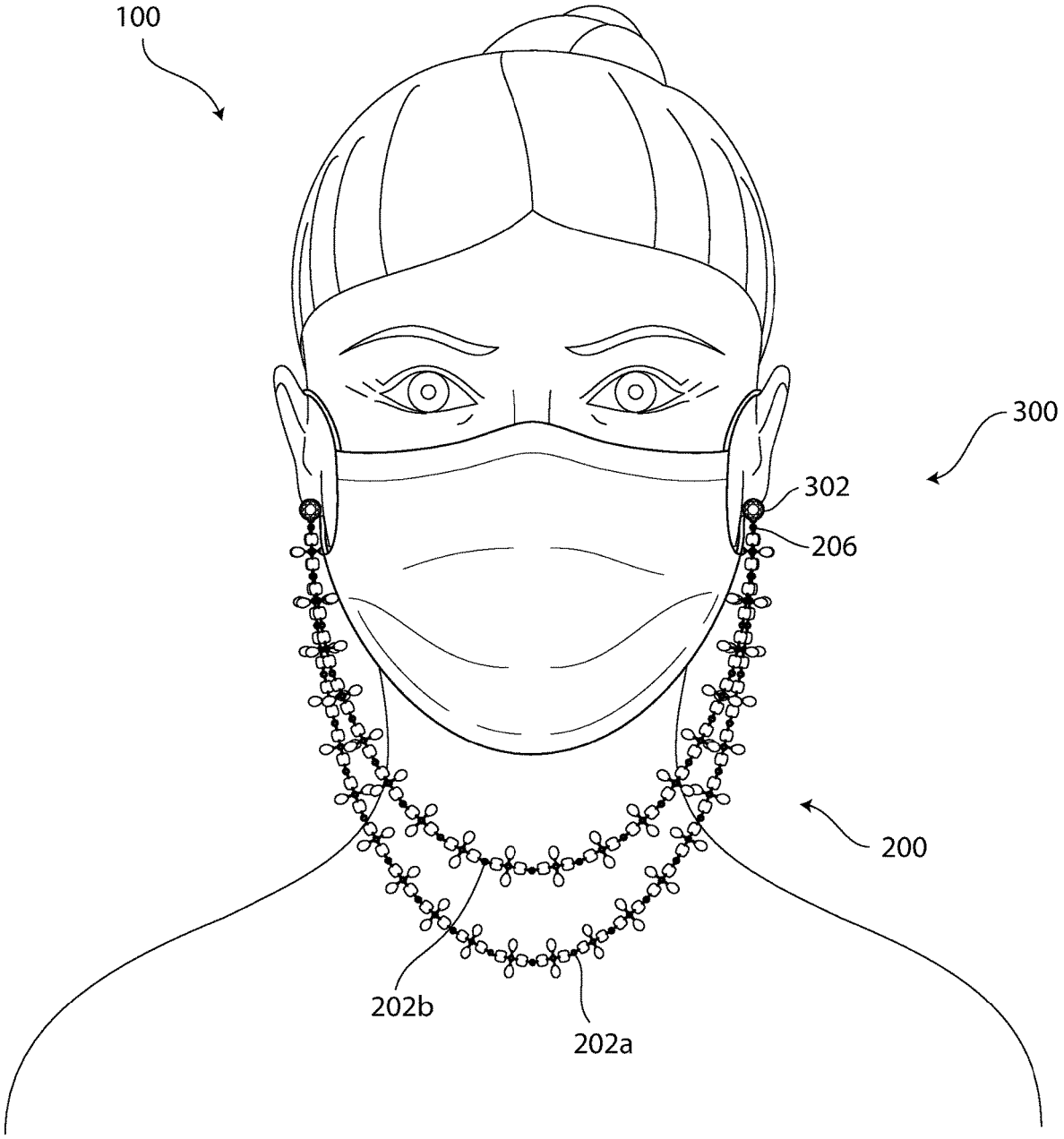
FIG. 3 illustrates an embodiment of a pair of lines worn by a wearer according to various principles of this disclosure.

FIG. 1 illustrates an embodiment of a line before selective securement of the line to a pair of earrings worn on a pair of ears of a wearer according to various principles of this disclosure. FIG. 2 illustrates an embodiment of a line after selective securement of the line to a pair of earrings worn on a pair of ears of a wearer according to various principles of this disclosure. FIG. 3 illustrates an embodiment of a pair of lines worn by a wearer according to various principles of this disclosure. In particular, there is illustrated a wearer 100, a line 200, and a pair of earrings 300.

The wearer 100 has a head 102, a plurality of hair 104, a pair of ears 106, a pair of ear areas 108, a facial covering 110 with a pair of straps 112 extending around the pair of ears 106, a neck 114, a pair of hands 116, and a chin 118, a frontal chest area 120. The wearer 100 is a person, but can be embodied in other ways. For example, the wearer 100 can be embodied as a showcase head, a mannequin, or another suitable form. For example, the facial covering 110 can include a surgical mask, a facial shield, a gaiter, a scarf, a ski mask, a balaclava, or another suitable facial covering.

Although the pair of ear areas 108 correspond a pair of ear lobes, this is not required. As such, each ear area of the pair of ear areas 108 can correspond to any portions of each ear 106, whether same or different ones. For example, some of ear areas 108 can include a helix region, a concha region, or others can include an earlobe (lobule), a helix, a concha, a superior concha, a crus, a superior crus, an antitragus, an antihelix, a scapha, a triangular fossa, a concha cymba, a tragus, or other suitable ear areas 108. For example, the pair of ear areas 108 can be lobes on which the pair of earrings 300 is worn. For example, the pair of ear areas 108 can be not lobes on which the pair of earrings 300 is worn.

The pair of earrings 300 includes a pair of individual earrings 302 (e.g., with a post, a clip-on). For example, at least on individual earring 302 can include a post extending between a front side of the ear 300 and an obverse side of the ear 300, as disclosed herein. For example, the post can extending along a horizontal plane, a vertical plane, or a diagonal plane. For example, the post may extend between a frontal piece (e.g., a decorative piece) and a backing, where the ear is positioned between the frontal piece (facing the front side of the ear 300) and the backing (facing the obverse side of the ear 300), as disclosed herein. For example, although the post is rectilinear, the post may extend in other ways (e.g., arcuate, sinusoidal, helical). For example, at least on individual earring 302 can include a clip-on earring having a front wing and a back wing, where the front wing and the back wing are elastically pivoted to each other (e.g., via a spring) or where the front wing and the back wing can be in magnetic securement through the ear 106.

The line 200 has an elongated portion 202 (e.g., a necklace, a chain, a braid, a rope, a string, a cable) hosting a plurality of decorative elements 204 (although the decorative elements can be omitted). The elongated portion 202 may be manually bendable, pivotable, shape memory, elastic, resilient, or flexible, but can be rigid (e.g., unable to be manually bent). The elongated portion 202 can include a metal (e.g., gold, silver, titanium), an alloy (e.g., brass, stainless steel), a plastic, a rubber, a wood, or other suitable materials. The decorative elements 204 can include can include a metal (e.g., gold, silver, titanium), an alloy (e.g., brass, stainless steel), a plastic, a rubber, a wood, a precious stone, whether natural or artificial, or other suitable materials.

The line 200 includes a pair of end portions (first and second) 206 longitudinally opposite and distal from each other on the elongated portion 202. Each of the end portion 206 includes a connector 208 (e.g., a jump ring, a clasp, a magnet, a fastener, a latch, a hook, a mating interface, a frontal piece of an earring, a post of an earring, a backing of an earring, a clip-on wing of an earring). Each respective connector 208 can be selectively secured (e.g., detachably attached, attachably detached, mounted, clasped, connected, fastened, mated, interlocked, magnetized, latched, grasped, hooked, hook-and-looped) and selectively unsecured (reversing selective securement) to and from each respective earring 300, independent of each other, as disclosed herein. The connectors 208 can be identical to each other or not identical to each other in terms of structure, properties (e.g., geometry, materials), or modality of operation. For example, each of the connectors 208 can be embodied as a jump ring or a clasp, identical to each other or not identical to each other in terms of structure, properties (e.g., geometry, materials), or modality of operation. For example, one of the connectors 208 can be a jump ring or a backing of an earring 300 and another of the connectors 208 can be a clasp or a frontal piece of an earring 300. Note that although the line 200 can be selectively secured (e.g., detachably attached, attachably detached, mounted, clasped, connected, fastened, mated, interlocked, magnetized, latched, grasped, hooked, hook-and-looped) to and selectively unsecured (reversing selective securement) from the pair of earrings 300, this is not required. For example, the line 200 can be permanently secured (e.g., welded, soldered, molded, chiseled, 3D printed) to the pair of earrings 300 (e.g., inoperative or broken when unsecured).

In order to selectively secure (e.g., detachably attached, attachably detached, mounted, clasped, connected, fastened, mated, interlocked, magnetized, latched, grasped, hooked, hook-and-looped) the line 200 to the set of earrings 300 worn on the pair of ears 106 or vice versa, without taking off the pair of earrings 300 from the pair of ears 106 and without interfering with the facial covering 110, the wearer 100 may hold the line 200 by the pair of end portions 206 via the pair of hands 116 such that the elongated portion 202 arcuately, parabolically, hyperbolically, or gravitationally spans between the pair of hands 116, as illustrated in FIG. 1. Then, the wearer 100 may lift the pair of hands 116 towards the pair of ears 106, whether simultaneously or one-by-one, such that the pair of connectors 208 respectfully connect (e.g., detachably attached, attachably detached, mounted, clasped, connected, fastened, mated, interlocked, magnetized, latched, grasped, hooked, hook-and-looped) to the pair of individual earrings 302 such that the line 202 arcuately, parabolically, hyperbolically, or gravitationally spans between the pair of individual earrings 302, underneath the chin 118 and the facial covering 110, without taking off the pair of earrings 300 from the pair of ears 106, as illustrated in FIG. 2. Note that such span, whether rigid or non-rigid, can also avoid being underneath the chin 118 and can extend frontal of the chin 118 or at eye-level (e.g., to function as a pair of eyeglasses (e.g., a lens is on or secured to or enclosed by the line 200 having a U-shape or a C-shape functioning as an eyewear frame) or a head-mounted wearable (e.g., an electronic display is on or secured to or enclosed by the line 200 having a U-shape or a C-shape functioning as a frame)), whether front or back, or over the hair 104 (e.g., to function as a headband or a headphone when the pair of earrings 300 includes a pair of speakers). As such, the wearer 100 can extend the end portions 206 from the pair of earrings 300 such that the line 200 can arcuately, parabolically, hyperbolically, or gravitationally span between the pair of earrings 300. Note that the wearer 100 may adjust the facial covering 110 or the straps 112 when the wearer 100 desires to selectively secure or selectively unsecure the line 200 from the pair of earrings 300, if necessary or desired.

For example, if each of the connectors 208 is embodied as a jump ring, then the wearer 100 may detach the frontal piece or the backing of each individual earring 302, without taking off that respective earring 302, mount the jump ring onto the post, without taking off that respective earring 302, and then attach the frontal piece or the backing back onto that respective individual earring 302, without taking off that respective earring 302, as illustrated in FIG. 2. Note that the selectively securing at least one of the connectors 208, when embodied as the jump ring, to the frontal piece or the backing is possible, as disclosed herein. Likewise, one of the connectors 208 can be the frontal piece, the post, the backing, or the clip-on wing as well.

For example, if each of the connectors 208 is embodied as a clasp (e.g., a ring clasp, a lobster clasp), then the wearer 100 may open the clasp without taking off that respective earring 302 and mount the clasp onto the post, without taking off that respective earring 302, as illustrated in FIG. 2. Note that the selectively securing at least one of the connectors 208, when embodied as the clasp, to the frontal piece or the backing is possible, as disclosed herein. Likewise, one of the connectors 208 can be the frontal piece, the post, the backing, or the clip-on wing as well.

For example, if one of the connectors 208 is embodied as a clasp (or another connector 208) and another of the connectors 208 is embodied as a jump ring (or another connector 208), then these forms of selective securement can be mixed and matched, as disclosed herein. Likewise, if one of the individual earrings 302 is not worn on that respective ear 106, then a respective connector 208 can be selectively secured to that individual earring 302 at that time and then that individual earring 302 can be put on its respective ear 106 or vice versa. Similarly, if both individual earrings 302 are not worn on the pair of ears 106, then the pair of respective connectors 208 can be selectively secured to the pair of individual earrings 302 at that time and then the pair of individual earrings 302 can be put on the pair of ears 106 or vice versa. Note that these processes of selective securement, as disclosed herein, can be reversed when there is a desire to selectively unsecure a respective connector 208 or the pair of connectors 208 from a respective ear 106 or the pair of ears 106.

The pair of connectors 208 can respectfully independently connect to or respectfully independently disconnect from the pair of individual earrings 302, whether simultaneously and one-after-another, whether right after left or left after right. As such, once the pair of connectors 208 are independently connected to the pair of earrings 300, the end portions 206 of the line 200 can extend from the pair of earrings 300 via the pair of individual earrings 302. Resultantly, the line 202 can arcuately, parabolically, hyperbolically, or gravitationally (e.g., vertically down away from the chin 118) span (or otherwise extend) between the pair of individual earrings 302. Likewise, this selective securement can be reversed once the pair of connectors 208 are independently disconnected from the pair of earrings 300 and the end portions 206 of the line 200 can avoid extending from the pair of earrings 300 via the pair of individual earrings 302.

Although the line 200 may be selectively secured (e.g., detachably attached, attachably detached, mounted, clasped, connected, fastened, mated, interlocked, magnetized, latched, grasped, hooked, hook-and-looped) to and selectively unsecured (reversing selective securement) from the pair of earrings 300 via pair of the connectors 208, this is not required. For example, the line 200 can be permanently secured (e.g., welded, soldered, molded, chiseled, 3D printed) to the pair of earrings 300 (e.g., inoperative or broken when unsecured).

Although the pair of ear areas 108 are lobes, this is not required and can be adjusted, as needed. For example, the pair of ear areas 108 can be both identical (e.g., a pair of concha regions, a pair of helix regions) or not identical (e.g., a helix region and a lobe region, a concha region and a helix region). This may be technologically beneficial when some of the ear areas 108 may already be hosting other earrings (or ear worn devices like hearing aids or ear-fitting headphones) and therefore lack sufficient anatomical real estate. This may also be technologically beneficial if some ear areas 108 are physically lacking (e.g., for medical reasons) or unable to host an individual earring 300.

As illustrated in FIG. 3, the wearer 100 may desire to extend (e.g., span) another line 202*a* (second) from the pair of earrings 300. This extension can include permanent attachment or selective securement, as disclosed herein. In particular, there may be the first line 202*b* and the second line 202*a*, whether identical or non-identical to the first line 202*b* in terms of structure, properties (e.g., geometry, materials), or modality of operation. For example, the elongated portion 202*a*, at least one end portion 206*a*, or at least one connector 208*a* can be identical or non-identical to its respective counterpart of the first line 202*b* in terms of structure, properties (e.g., geometry, materials), or modality of operation. As such, the pair of end portions 206*a* of the second line 202*a* can extend from one or both of the individual earrings 302 or the first line 202*b* such that the second line 202*a* respectfully spans (or otherwise extends) arcuately, parabolically, hyperbolically, or gravitationally from its connection points. As illustrated in FIG. 3, this form of extension (e.g., spanning) can be underneath the chin 118 and the facial covering 110. Note that such span, whether rigid or non-rigid, can also avoid being underneath the chin 118 and can extend frontal of the chin 118 or at eye-level (e.g., to function as a pair of eyeglasses (e.g., a lens is on or secured to or enclosed by the line 200 having a U-shape or a C-shape functioning as an eyewear frame) or a head-mounted wearable (e.g., an electronic display is on or secured to or enclosed by the line 200 having a U-shape or a C-shape functioning as a frame)), whether front or back, or over the hair 104 (e.g., to function as a headband or a headphone when the pair of earrings 300 includes a pair of speakers). The first line 202*b* and the second line 202*a* can be identical or non-identical in longitudinal length, which may affect how far from the chin 118 or the facial coverings the first line 202*b* or the second line 202*a* extend or are spaced apart. For example, as illustrated in FIG. 3, the second line 202*a* encloses the first line 202*b*, but this can be reversed where the first line 202*b* encloses the second line 202*a*. For example, as illustrated in FIG. 3, the first line 202*b* has a first vertex (e.g., a lowest point when worn gravitationally) and the second line 202*a* has a second vertex (e.g., a lowest point when worn gravitationally), where the first vertex is co-aligned with the second vertex along a vertical plane based on the first line 202*b* arcuately, parabolically, hyperbolically, or gravitationally spanning between the first earring and the second earring. For example, as illustrated in FIG. 3, the first line 202*b* extends between the second line 202*a* and the chin 118 based on the first line 202*b* arcuately, parabolically, hyperbolically, or gravitationally spanning between the individual earrings 302.

Although FIG. 3 illustrates the second line 202*a* being extended (e.g., spanned suspended, selectively secured) arcuately, parabolically, hyperbolically, or gravitationally from the first line 202*a* between the pair of individual earrings 302, this is not required. For example, the second line 202*a* can extend (e.g., span, suspend, selectively secure) arcuately, parabolically, hyperbolically, or gravitationally from the pair of individual earrings 302, as disclosed herein with respect to the first line 202*b*. For example, the second line 202*a* can extend (e.g., span, suspend, selectively secure) arcuately, parabolically, hyperbolically, or gravitationally from one of the individual earrings 302 and the first line 202*b*, as disclosed herein with respect to the first line 202*b*.

Figure 4:
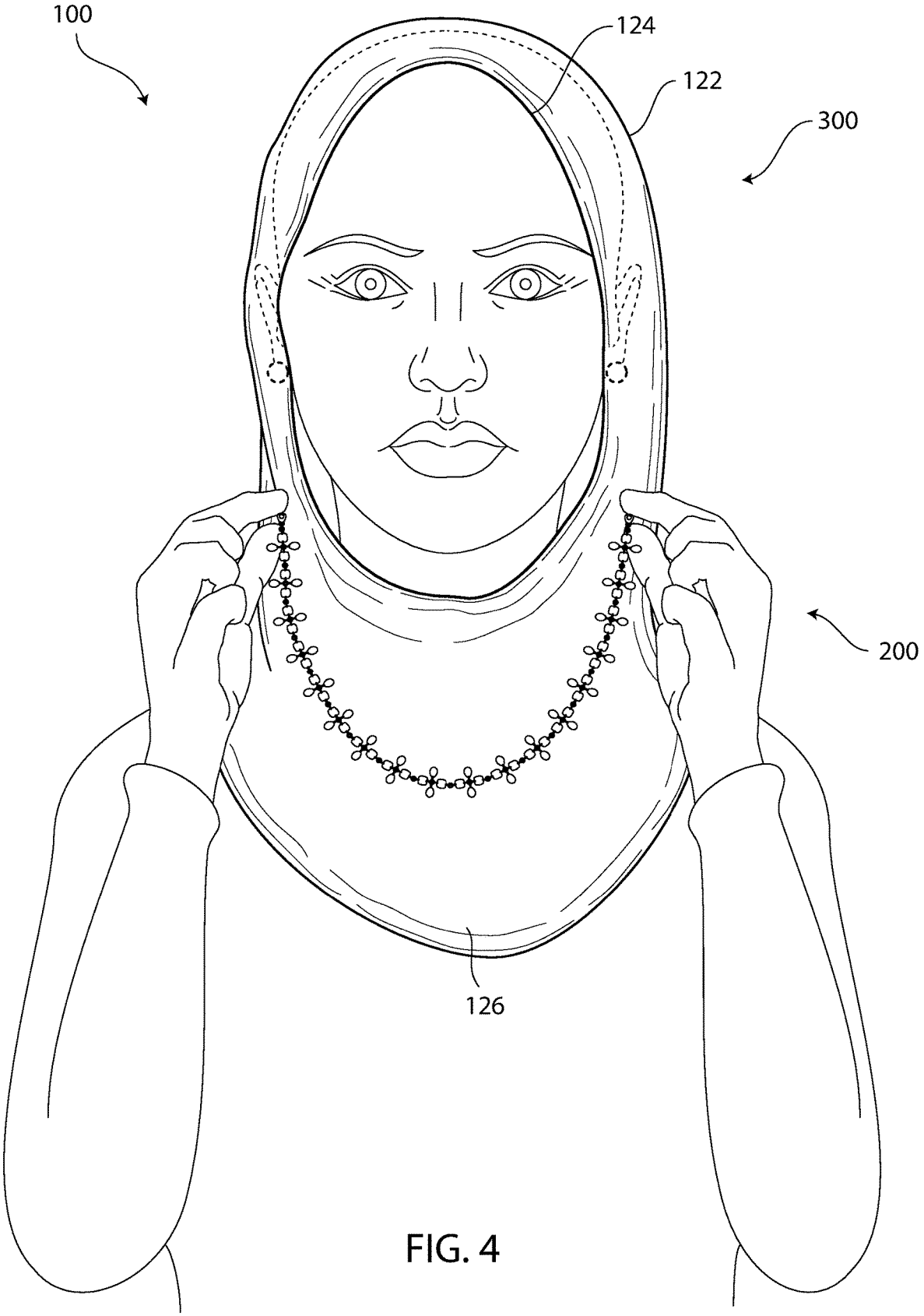
FIG. 4 illustrates an embodiment of a line before selective securement of the line to a pair of earrings worn on a pair of ears of a wearer covered by a head covering according to various principles of this disclosure.
Figure 5:
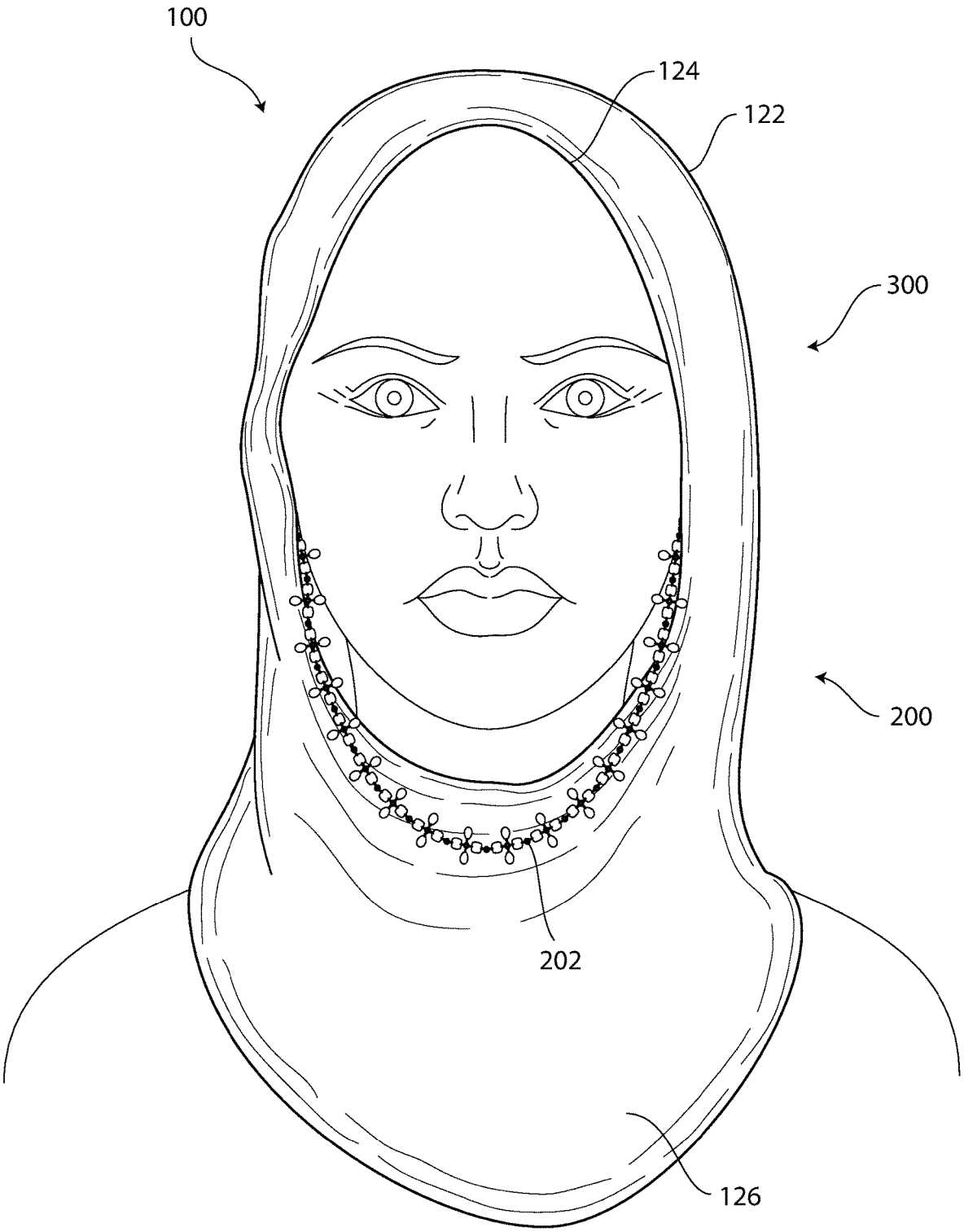
FIG. 5 illustrates an embodiment of a line after selective securement of the line to a pair of earrings worn on a pair of ears of a wearer covered by a head covering according to various principles of this disclosure.
Figure 6:
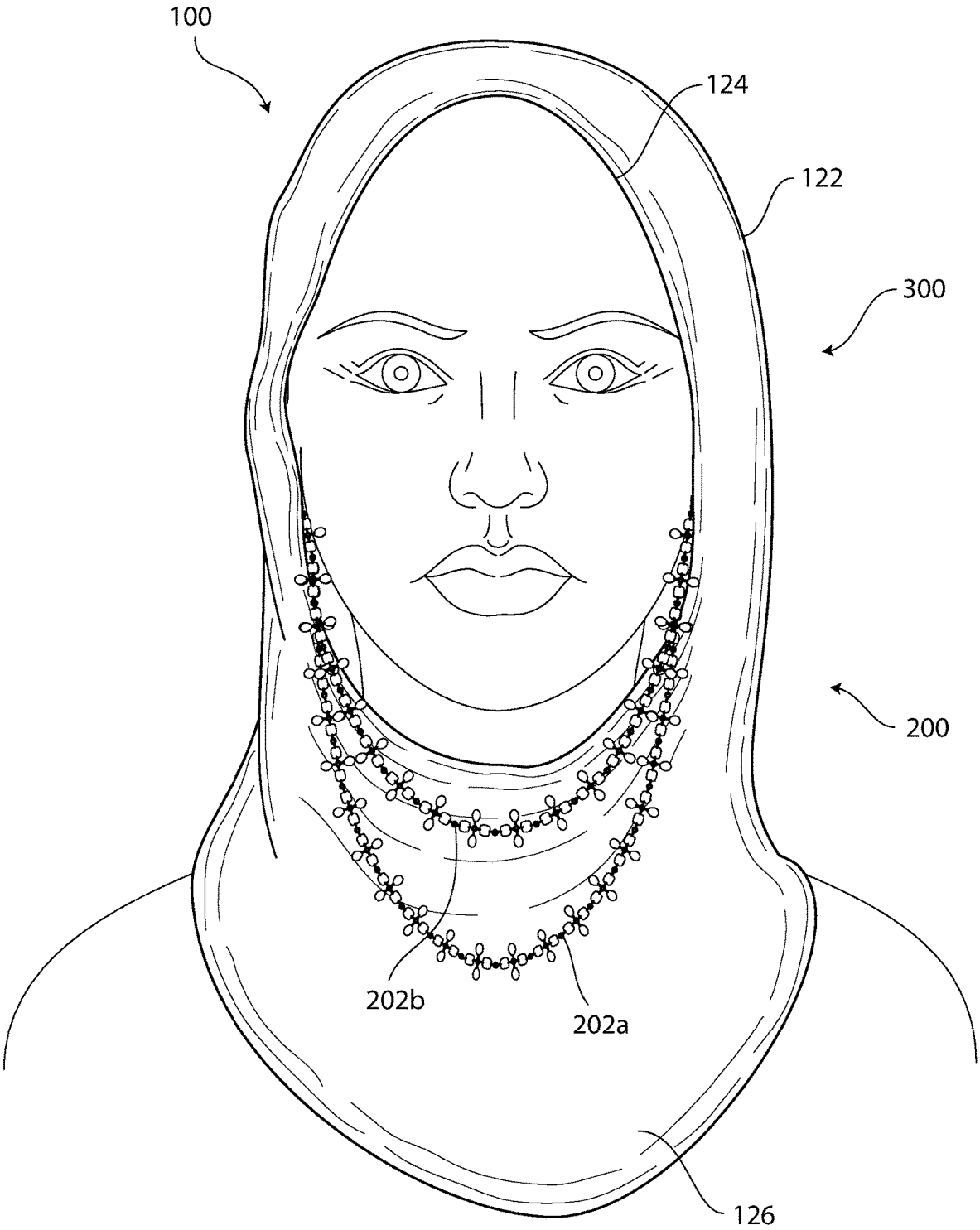
FIG. 6 illustrates an embodiment of a pair of lines worn by a wearer with a head covering according to various principles of this disclosure.

FIG. 4 illustrates an embodiment of a line before selective securement of the line to a pair of earrings worn on a pair of ears of a wearer covered by a head covering according to various principles of this disclosure. FIG. 5 illustrates an embodiment of a line after selective securement of the line to a pair of earrings worn on a pair of ears of a wearer covered by a head covering according to various principles of this disclosure. FIG. 6 illustrates an embodiment of a pair of lines worn by a wearer with a head covering according to various principles of this disclosure. In particular, the wearer 100 may wear a hijab 122 covering the hair 104. The hijab 100 has a facial opening 124 and a below-chin portion 126. The below-chin portion 126 extends underneath the chin 118. Note that the hijab 122 is not required and other head coverings may be used. For example, some of such head coverings can include a turban, a headscarf, a veil, a beanie, a knit cap, or another suitable head covering.

When the wearer 100 wears the hijab 122, the line 200 can still extend (e.g., span, suspend, selectively secure) from the pair of earrings 300. For example, the line 200 can be permanently attached to or selectively secure to or selectively unsecure from the pair of earrings 300, as disclosed herein. However, the elongated portion 202 extends out of the facial opening 124 and over the below-chin portion 126 such that (1) the elongated portion 202 arcuately, parabolically, hyperbolically, or gravitationally spans between the pair of individual earrings 302 underneath the chin 118 and (2) the elongated portion 202 is visible when frontally observing a face of the wearer 100 through the facial opening 124. Therefore, the wearer 100 can extend (e.g., span, suspend, selectively secure) the end portions 206 from the pair of individual earrings 302 worn on the pair of ears 106 and covered by the hijab 122 (or the facial covering 110). This form extension (e.g., span, suspend, selectively secure) extends the elongated portion 202 out of the facial opening 124 and over the below-chin portion 126 (or the facial covering 110) such that (1) the elongated portion 202 arcuately, parabolically, hyperbolically, or gravitationally spans between the pair of individual earrings 302 underneath the chin 118 (or the facial covering 110), and (2) the elongated portion 202 is visible when frontally observing the face of the wearer through the facial portion 124. The wearer 100 may adjust the facial opening 124 when the wearer 100 desires to selectively secure or selectively unsecure the line 200 from the pair of earrings 300 covered by the hijab 122. If the wearer 100 is wearing the facial covering 110, then the wearer 100 may adjust the facial covering 110 or the pair of straps 112. As such, the wearer 100 may wear the hijab 122, whether with or without the facial covering 110, having the facial opening 124 through which the line 202 extends based on the line 202 arcuately, parabolically, hyperbolically, or gravitationally spanning between the pair of earrings 300.

As illustrated in FIG. 6, the wearer 100 may desire to extend another line 202*a* (second) from the pair of earrings 300. This extension can include permanent attachment or selective securement, as disclosed herein. In particular, there may be the first elongated portion 202*b* and the second elongated portion 202*a*, whether identical or non-identical to the first line 202*b* in terms of structure, properties (e.g., geometry, materials), or modality of operation. For example, the second elongated portion 202*a*, at least one end portion 206*a*, or at least one connector 208*a* can be identical or non-identical to its respective counterpart of the first line 202*b* in terms of structure, properties (e.g., geometry, materials), or modality of operation. As such, the pair of end portions 206*a* of the second line 202*a* can extend from one or both of the individual earrings 302 or the first line 202*b* such that the second line 202*a* respectfully spans arcuately, parabolically, hyperbolically, or gravitationally its connection points. As illustrated in FIG. 6, this form of spanning (or extension) can be underneath the chin 118 and the facial covering 110. Note that such span, whether rigid or non-rigid, can also avoid being underneath the chin 118 and can extend frontal of the chin 118 or at eye-level (e.g., to function as a pair of eyeglasses (e.g., a lens is on or secured to or enclosed by the line 200 having a U-shape or a C-shape functioning as an eyewear frame) or a head-mounted wearable (e.g., an electronic display is on or secured to or enclosed by the line 200 having a U-shape or a C-shape functioning as a frame)), whether front or back, or over the hair 104 (e.g., to function as a headband or a headphone when the pair of earrings 300 includes a pair of speakers). The first line 202*b* and the second line 202*a* can be identical or non-identical in longitudinal length, which may affect how far from the chin 118 or the facial coverings the first line 202*b* or the second line 202*a* extend or are spaced apart. For example, as illustrated in FIG. 6, the second line 202*a* encloses the first line 202*b*, but this can be reversed where the first line 202*b* encloses the second line 202*a*. For example, as illustrated in FIG. 6, the first line 202*b* has a first vertex (e.g., a lowest point when worn gravitationally) and the second line 202*a* has a second vertex (e.g., a lowest point when worn gravitationally), where the first vertex is co-aligned with the second vertex along a vertical plane based on the first line 202*b* arcuately, parabolically, hyperbolically, or gravitationally spanning between the first earring and the second earring. For example, as illustrated in FIG. 6, the first line 202*b* extends between the second line 202*a* and the chin 118 based on the first line 202*b* arcuately, parabolically, hyperbolically, or gravitationally spanning (or extending) between the individual earrings 302. As disclosed herein, the hijab 122 (e.g., the facial opening 124) or the facial covering 110 or the pair of straps 112 may need to be adjusted to accommodate extension (e.g., span, suspend, selectively secure) of the second line 202*a*.

Figure 7:
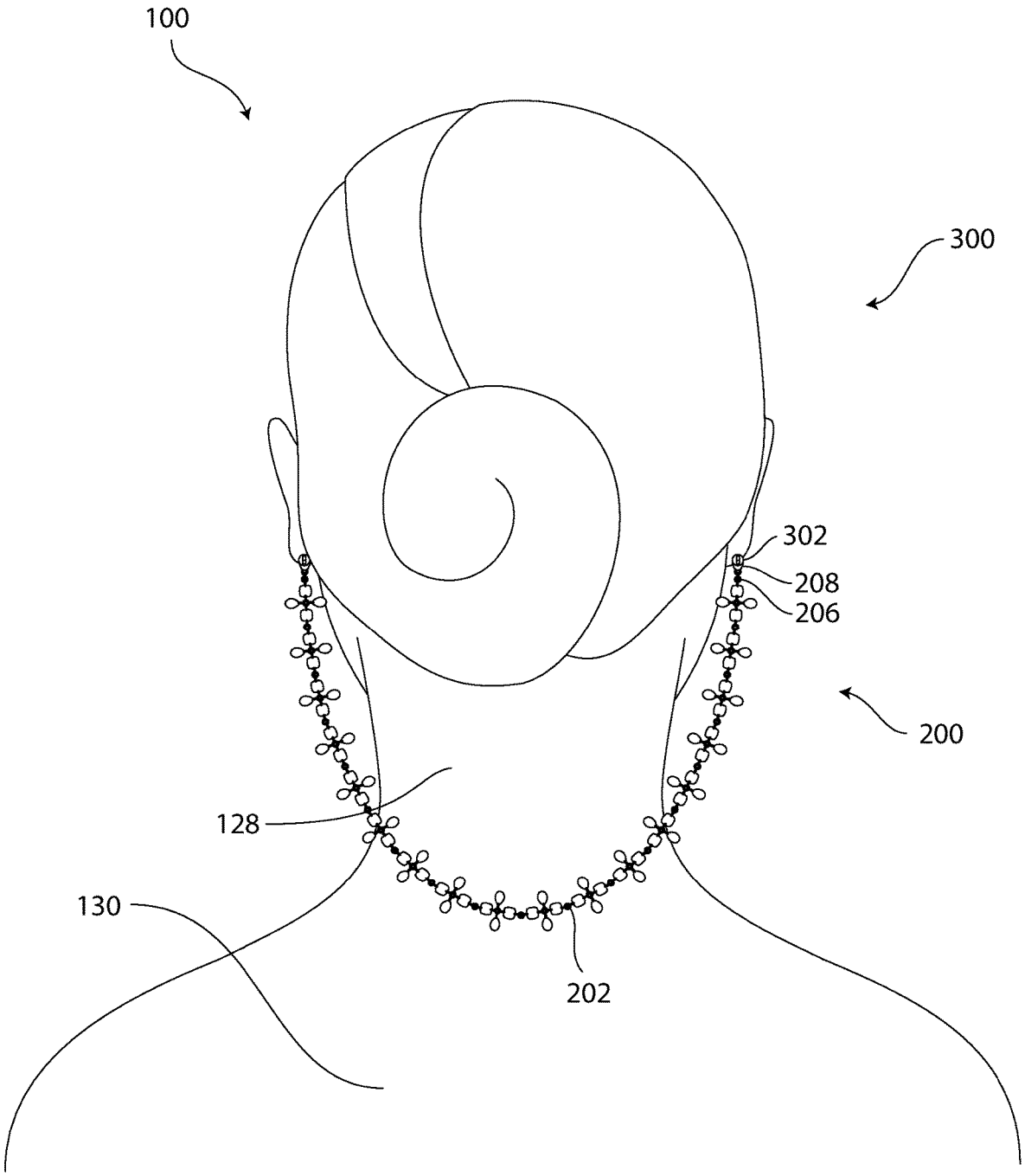
FIG. 7 illustrates an embodiment of a line being worn over a back neck portion of a wearer according to various principles of this disclosure.
Figure 8:
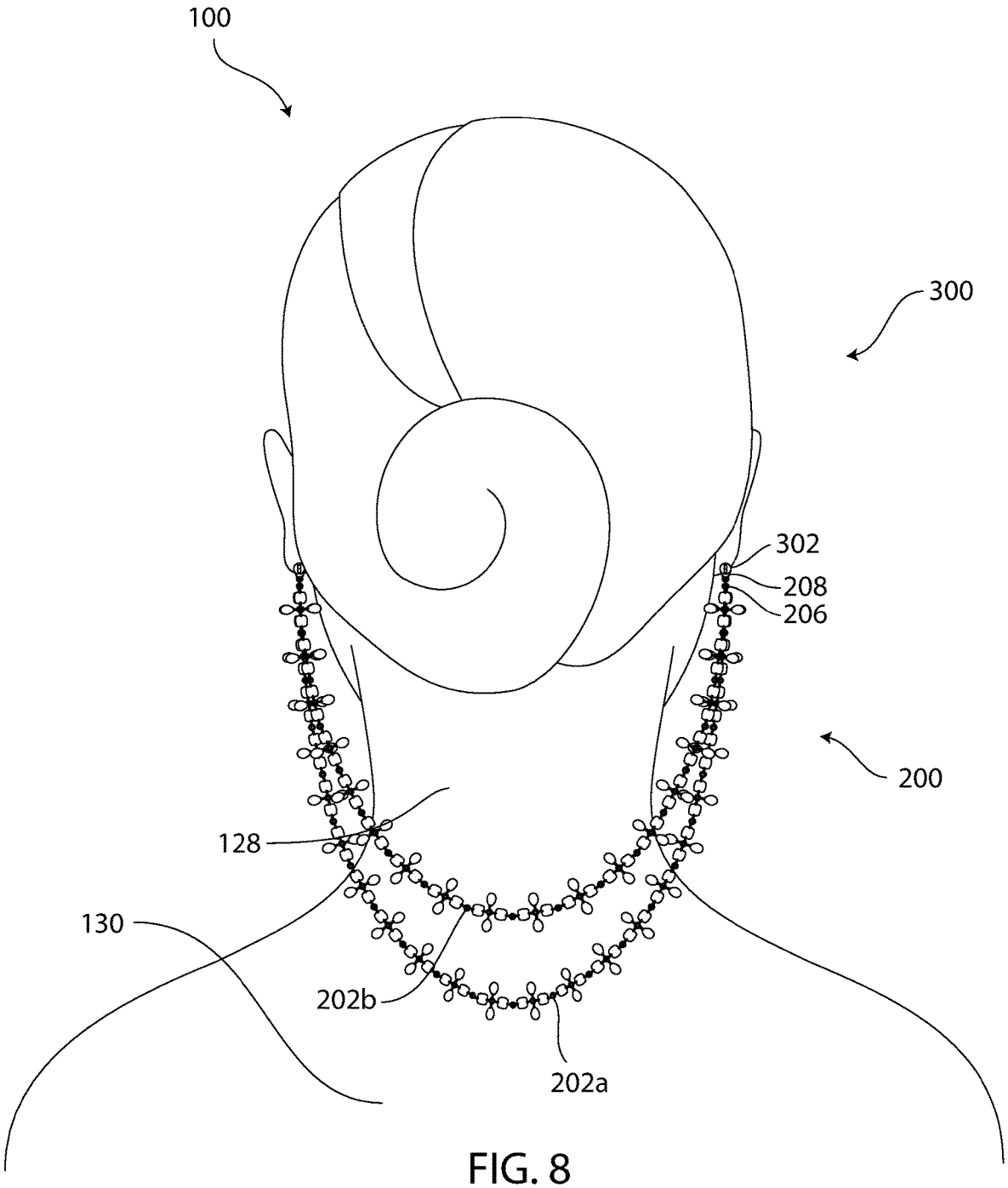
FIG. 8 illustrates an embodiment of a pair of lines being worn over a back neck portion of a wearer according to various principles of this disclosure.

FIG. 7 illustrates an embodiment of a line being worn over a back neck portion of a wearer according to various principles of this disclosure. FIG. 8 illustrates an embodiment of a pair of lines being worn over a back neck portion of a wearer according to various principles of this disclosure. In particular, like the FIGS. 1-6, the line 200 is similarly extended (e.g., span, suspend, selectively secure) from the pair of earrings 300. However, since the wearer 100 has a back neck portion 128, a shoulder portion, and an upper back portion 130, the elongated portion 202 extends (e.g., span, suspend, selectively secure) from the pair of earrings 300 over at least one of the back neck portion 128, the shoulder portion, or the upper back portion 130 based on the elongated portion 202 arcuately, parabolically, hyperbolically, or gravitationally spanning between the pair of earrings 300, as illustrated in FIG. 7. This may be technologically beneficial if the wearer 100 desires to show the line 200 to those behind the wearer 100 or the wearer 100 is wearing a clothing item with a back portion that aesthetically matches the elongated portion 202. Likewise, as illustrated in FIG. 8, the wearer 100 may desire to extend another line 202*a* (second) from the pair of earrings 300. As such, just like disclosed in FIG. 3 and FIG. 6, the wearer 100 may wear the second line 202*a* such that the second line 202*a* extends (e.g., span, suspend, selectively secure) from the pair of earrings 300 over at least one of the back neck portion 128, the shoulder portion, or the upper back portion 130 based on the elongated portion 202*a* arcuately, parabolically, hyperbolically, or gravitationally spanning between the pair of earrings 300, as illustrated in FIG. 8.

Figure 9:
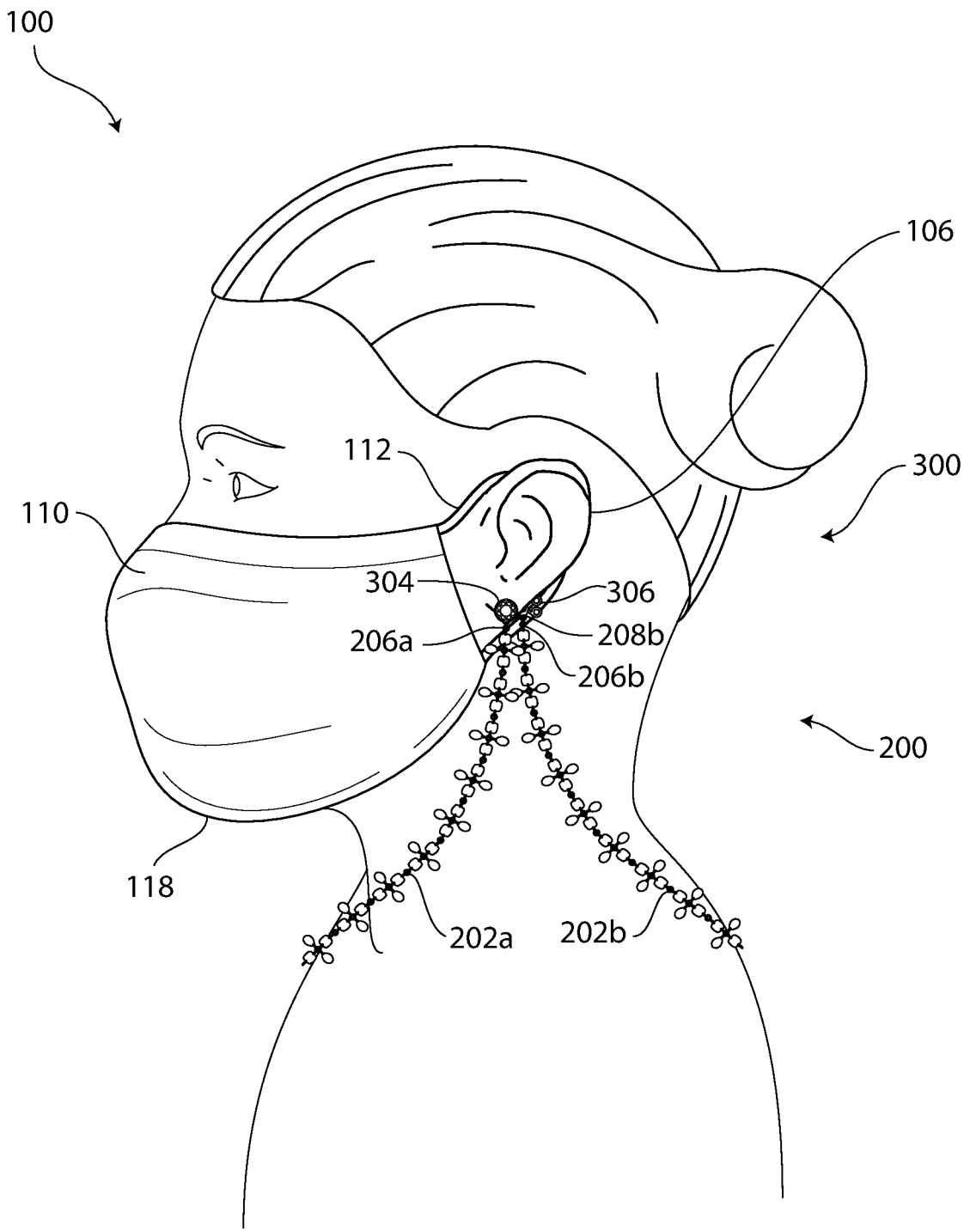
FIG. 9 illustrates an embodiment of a first line being worn under a chin of a wearer and a second line being worn over a back neck portion of the wearer according to various principles of this disclosure.
Figure 10:
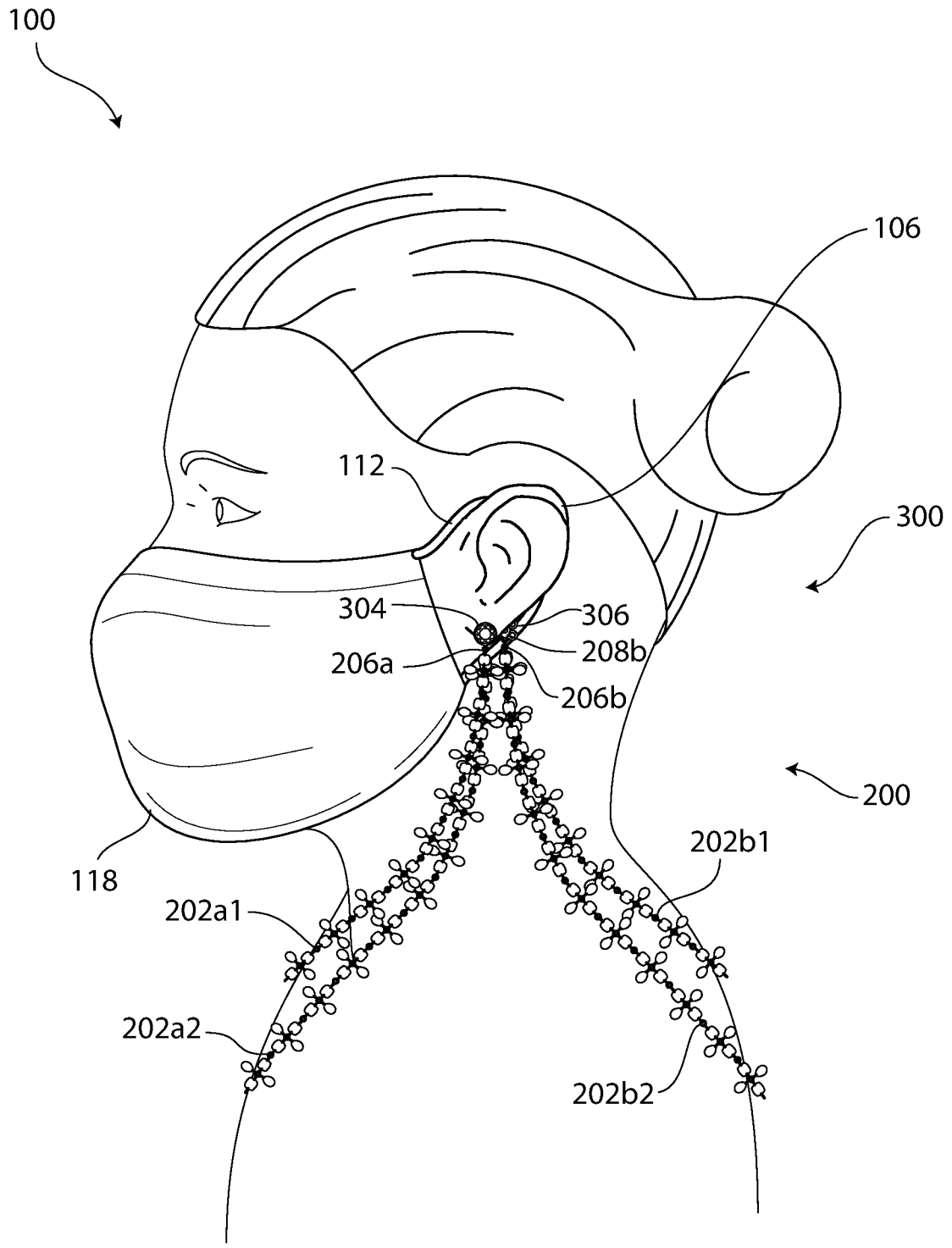
FIG. 10 illustrates an embodiment of a first pair of lines being worn under a chin of a wearer and a second pair of lines being worn over a back neck portion of the wearer according to various principles of this disclosure.
Figure 14:
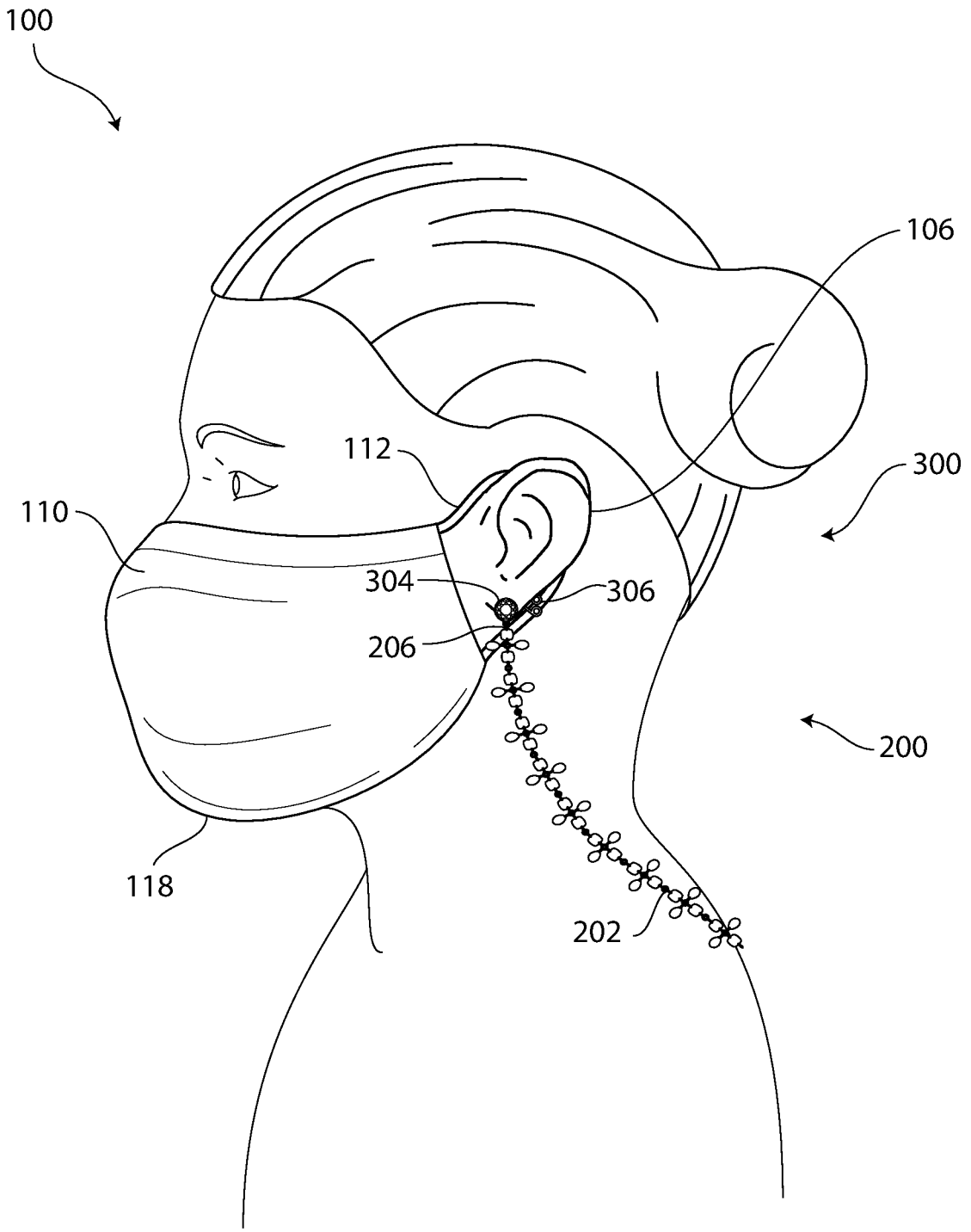
FIG. 14 illustrates an embodiment of a line extending from a pair of earrings worn on a pair of ears of a wearer wearing a facial covering where the line extends over a back neck portion, a shoulder portion, or an upper back portion of the wearer according to various principles of this disclosure.
Figure 15:
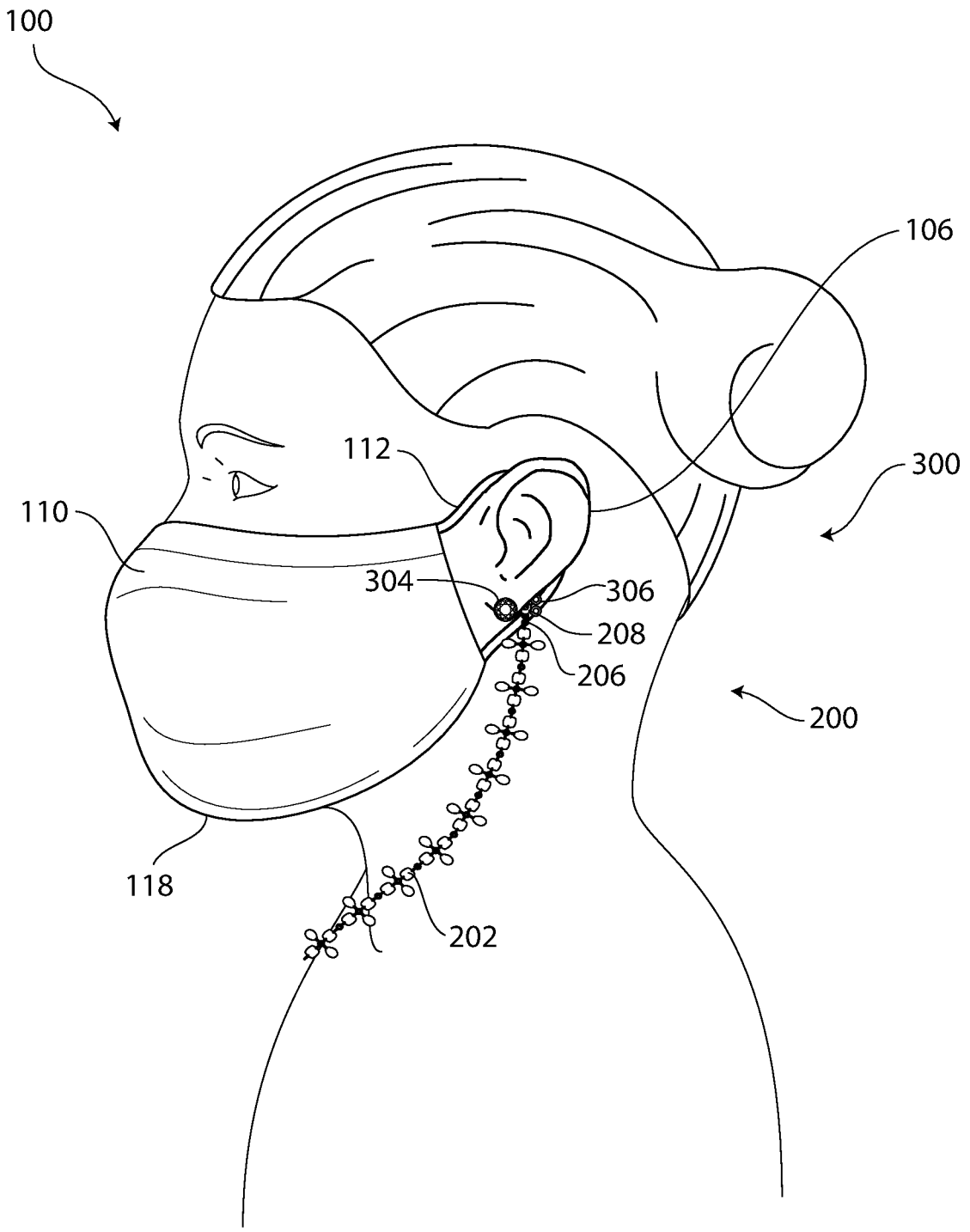
FIG. 15 illustrates an embodiment of a line extending from a pair of earrings worn on a pair of ears of a wearer wearing a facial covering where the line extends underneath a chin of the wearer according to various principles of this disclosure.
Figure 16:
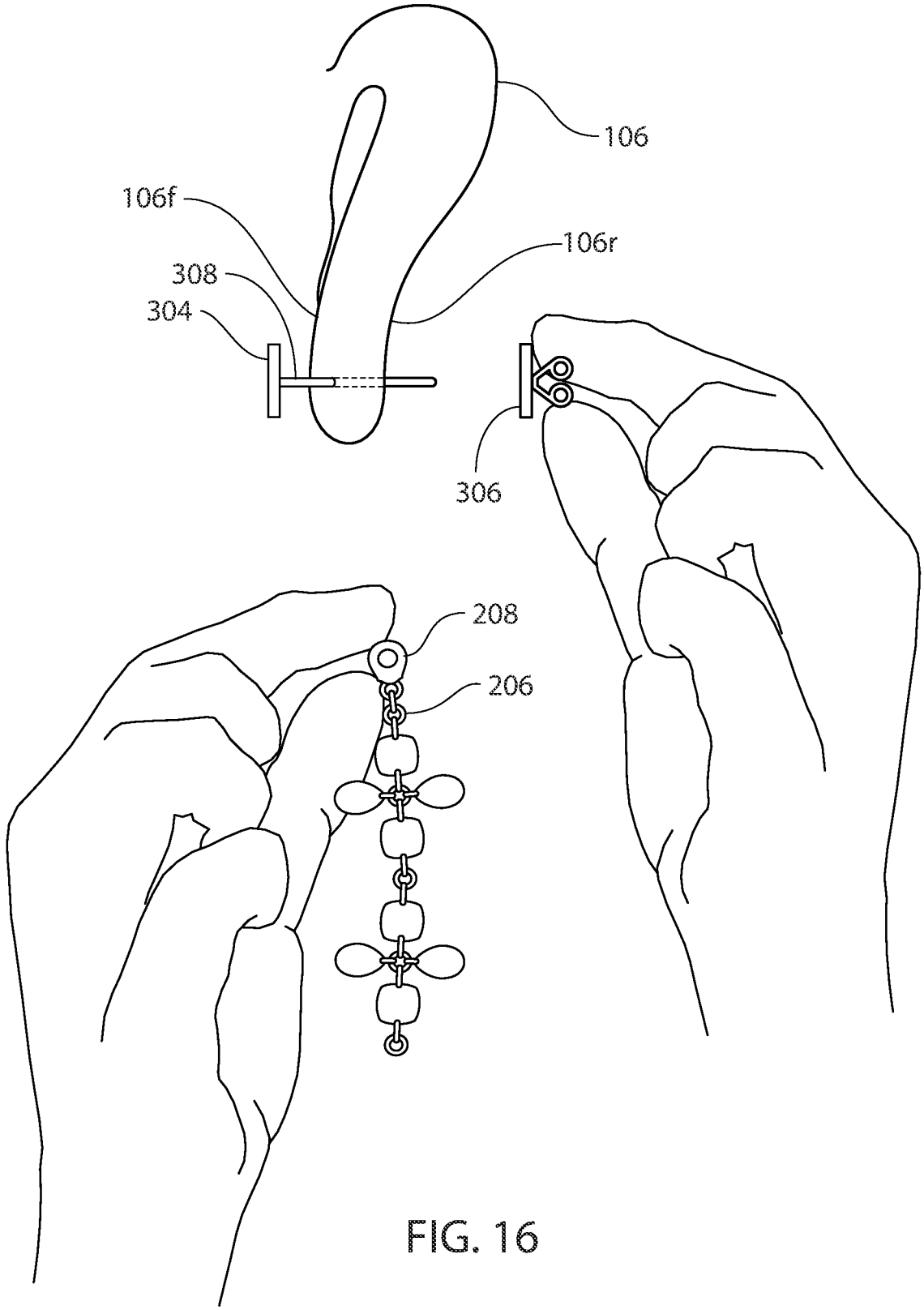
FIG. 16 to FIG. 19 illustrates an embodiment of a method of selectively securing an end portion of a line to an earring worn on an ear of a wearer according to various principles of this disclosure.
Figure 17:
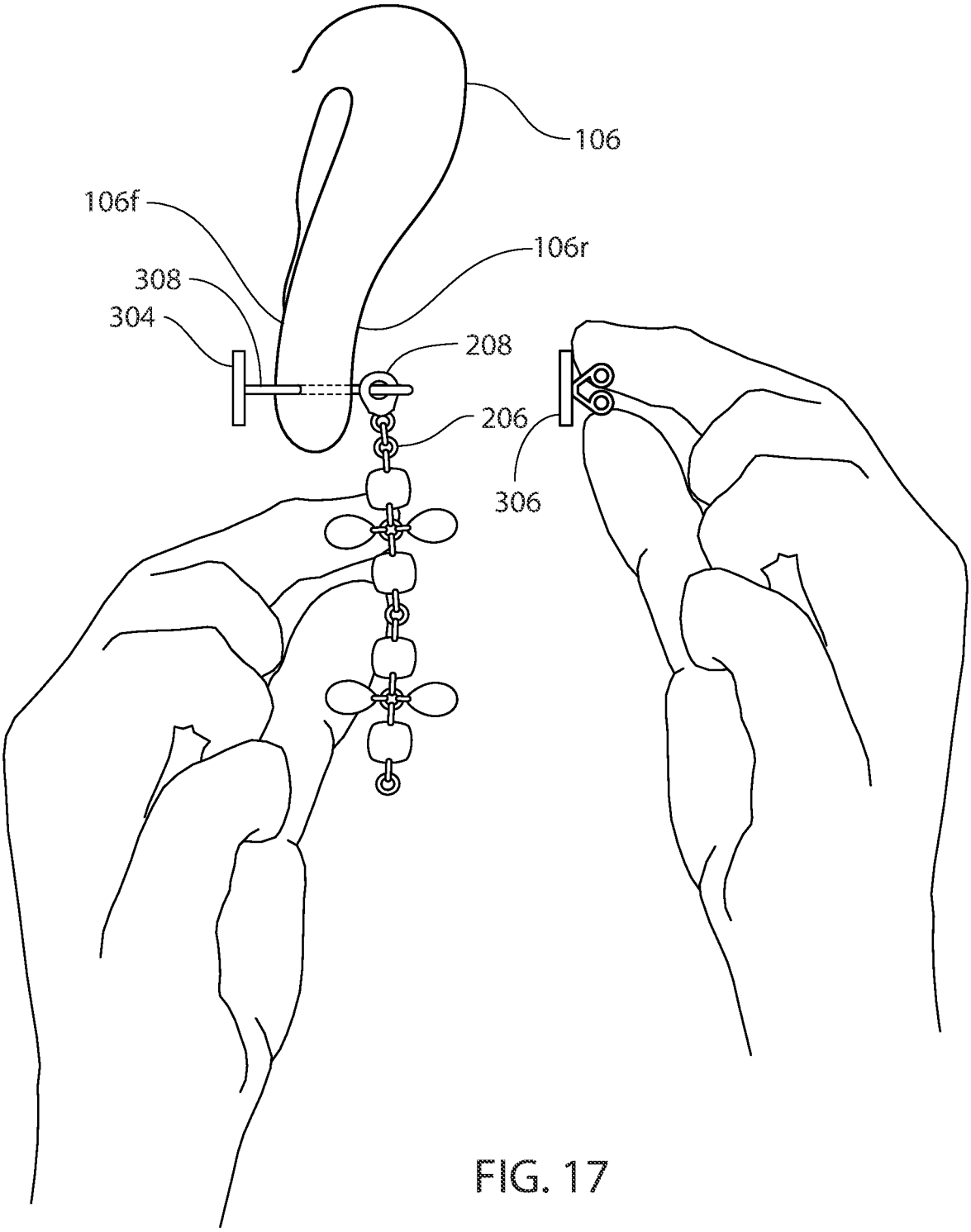
Figure 18:
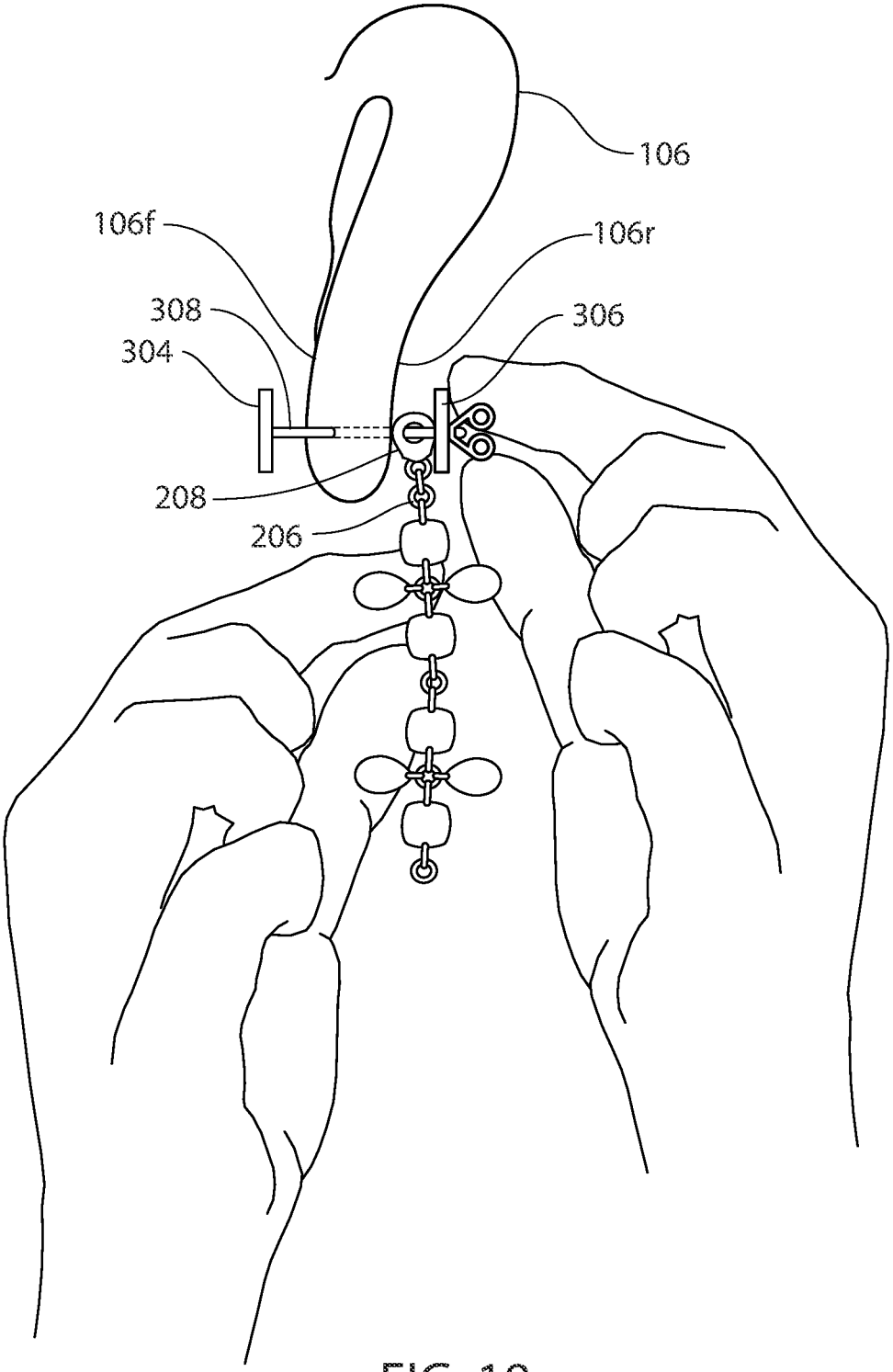
Figure 19:
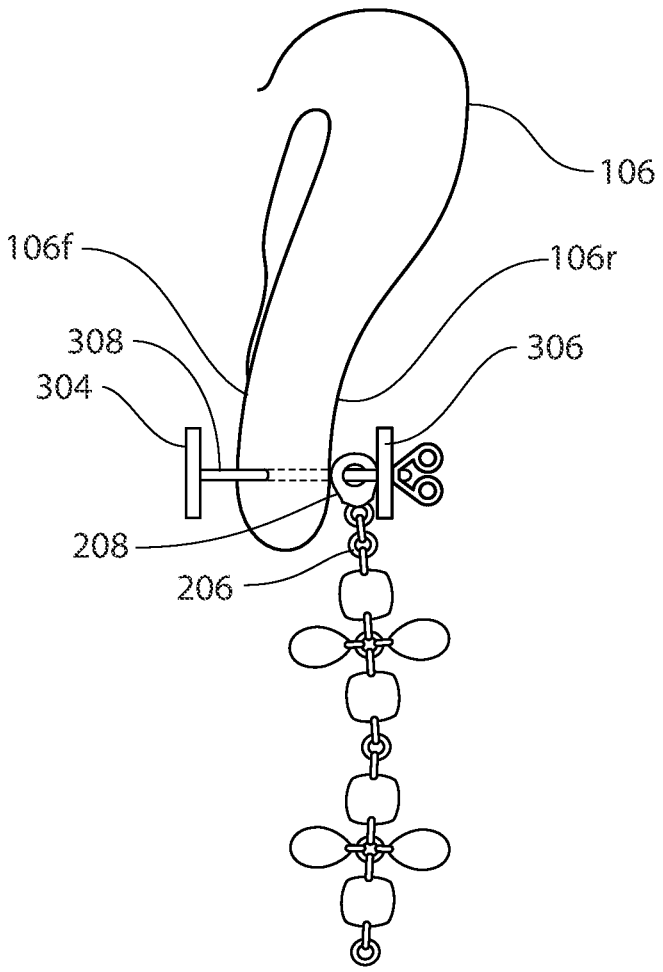
Figure 20:
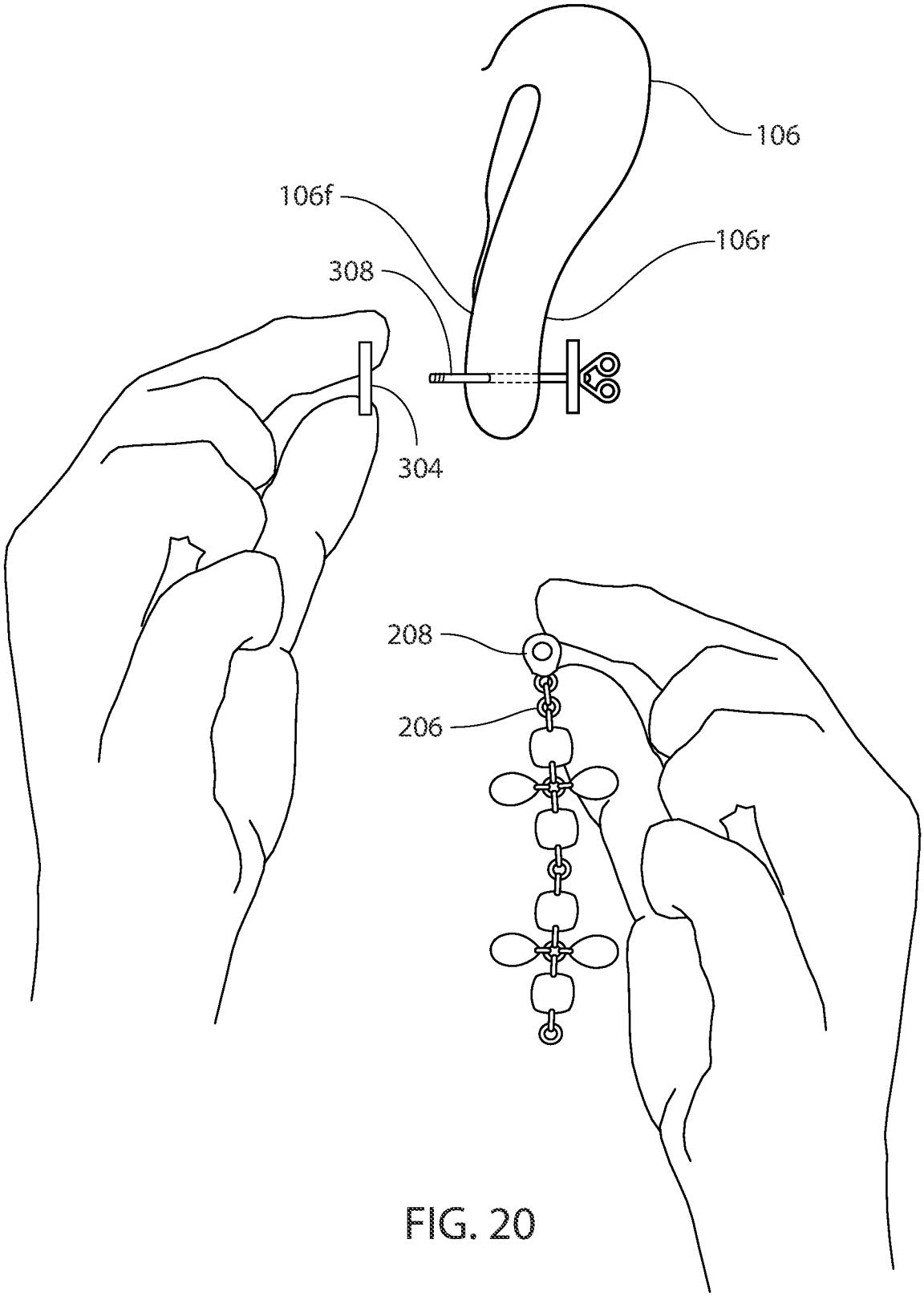
FIG. 20 to FIG. 23 illustrates an embodiment of a method of selectively securing an end portion of a line to an earring worn on an ear of a wearer according to various principles of this disclosure.
Figure 21:
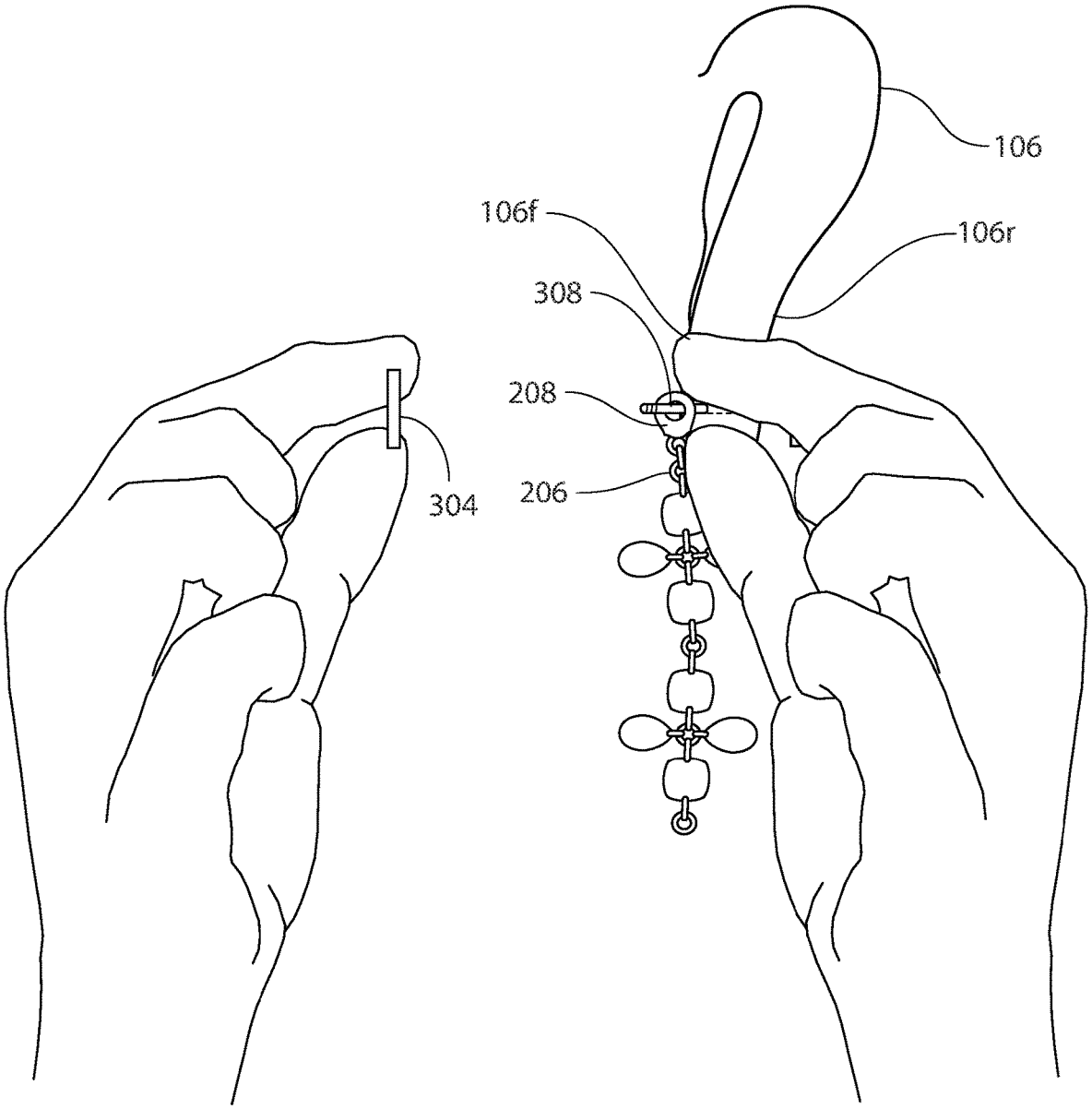
Figure 22:
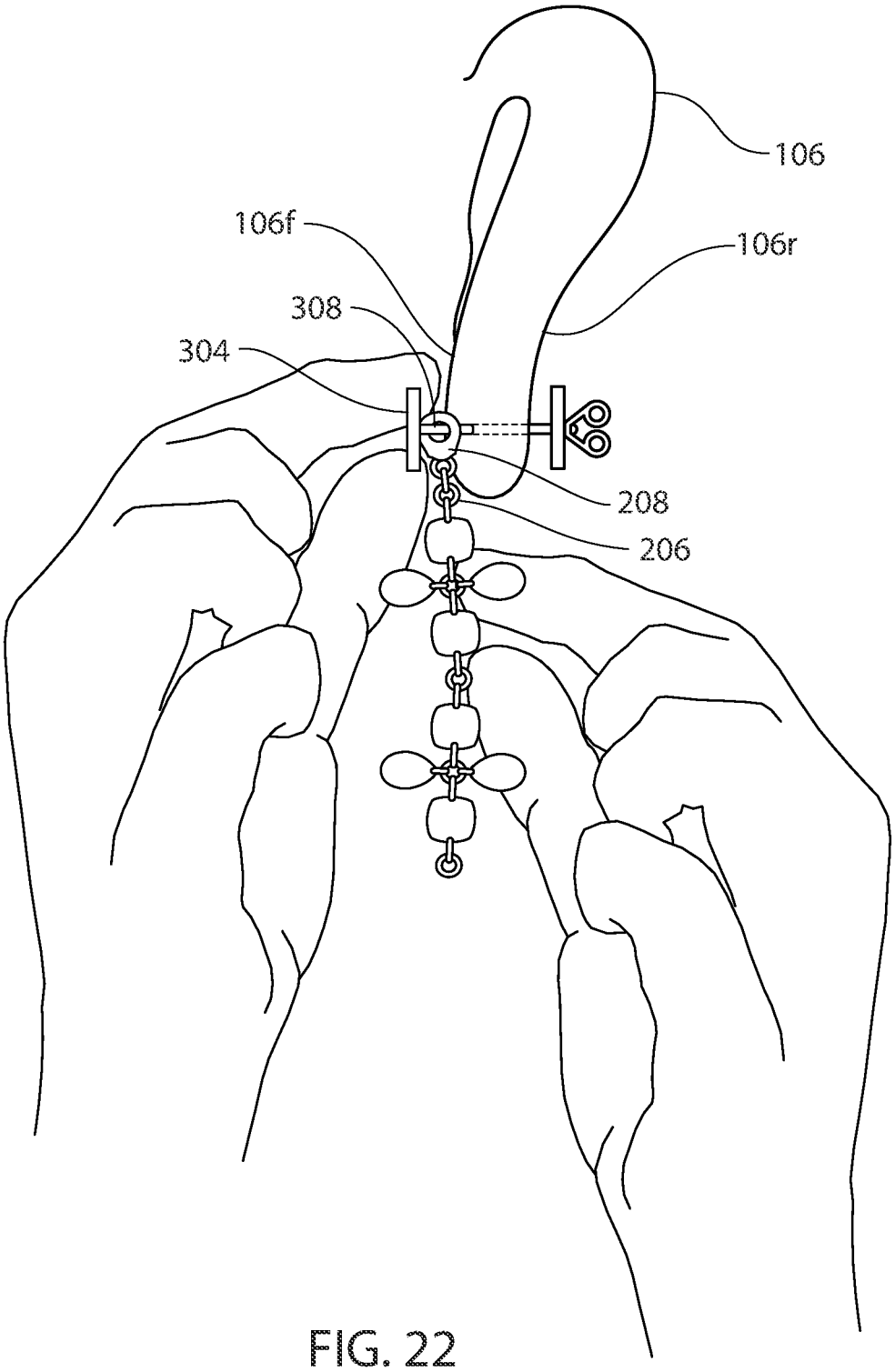
Figure 23:
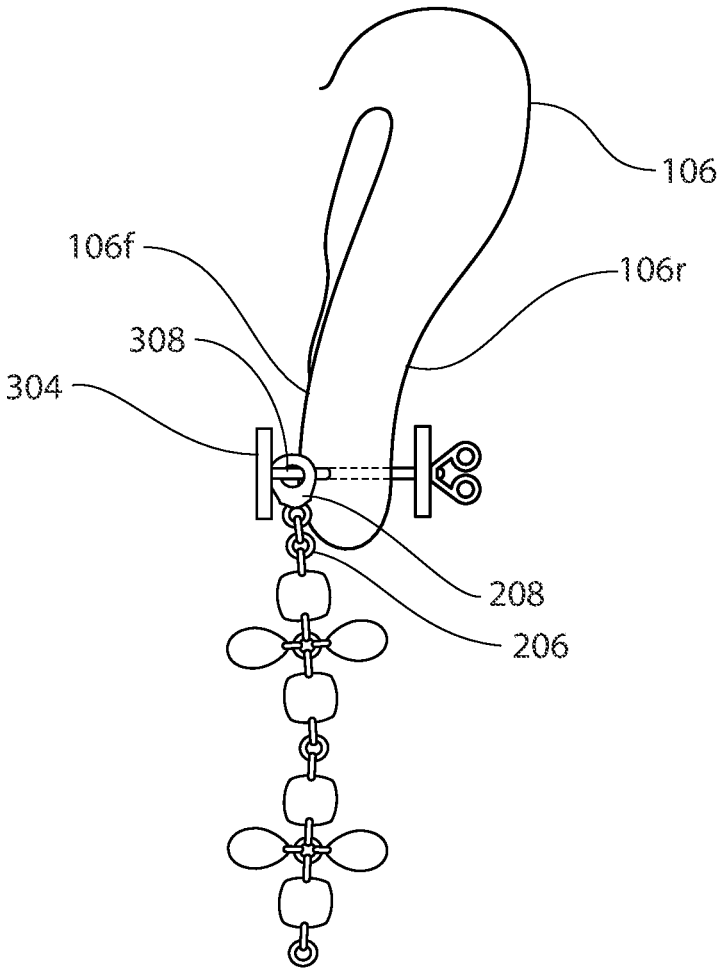

FIG. 9 illustrates an embodiment of a first line being worn under a chin of a wearer and a second line being worn over a back neck portion of the wearer according to various principles of this disclosure. FIG. 10 illustrates an embodiment of a first pair of lines being worn under a chin of a wearer and a second pair of lines being worn over a back neck portion of the wearer according to various principles of this disclosure. FIG. 14 illustrates an embodiment of a line extending from a pair of earrings worn on a pair of ears of a wearer wearing a facial covering where the line extends over a back neck portion, a shoulder portion, or an upper back portion of the wearer according to various principles of this disclosure. FIG. 15 illustrates an embodiment of a line extending from a pair of earrings worn on a pair of ears of a wearer wearing a facial covering where the line extends underneath a chin of the wearer according to various principles of this disclosure. In particular, the wearer 100 has the pair of individual earrings 302, each having a frontal piece 304 (e.g., a decorative piece) and a backing 306. As such, the wearer 100 can simultaneously wear the first elongated portion 202*a* and the second elongated portion 202*b*, where the first elongated portion 202*a* extends (e.g., span, suspend, selectively secure) from the pair of earrings 300 over the front chest area 120 underneath the chin 118 and the facial covering 110 and the second elongated portion 202*b* extends (e.g., span, suspend, selectively secure) from the pair of earrings 300 over at least one of the back neck portion 128, the shoulder portion, or the upper back portion 130 based on the first elongated portion 202*a* and the second elongated portion 202*b* arcuately, parabolically, hyperbolically, or gravitationally spanning between the pair of earrings 300, as illustrated in FIG. 9. Further, as illustrated in FIG. 10, the wearer 100 may add a third line 200 and a fourth line 200, where the first line is labeled 202*a*1, the second line is labeled 202*b*1, the third line is labeled 202*a*2, and the fourth line is labeled 202*b*2. Each of the first line 202*a*1, the second line 202*b*1, the third line 202*a*2, and the fourth line 202*b*2 may be worn, as disclosed in FIGS. 1-9.

Figure 13:
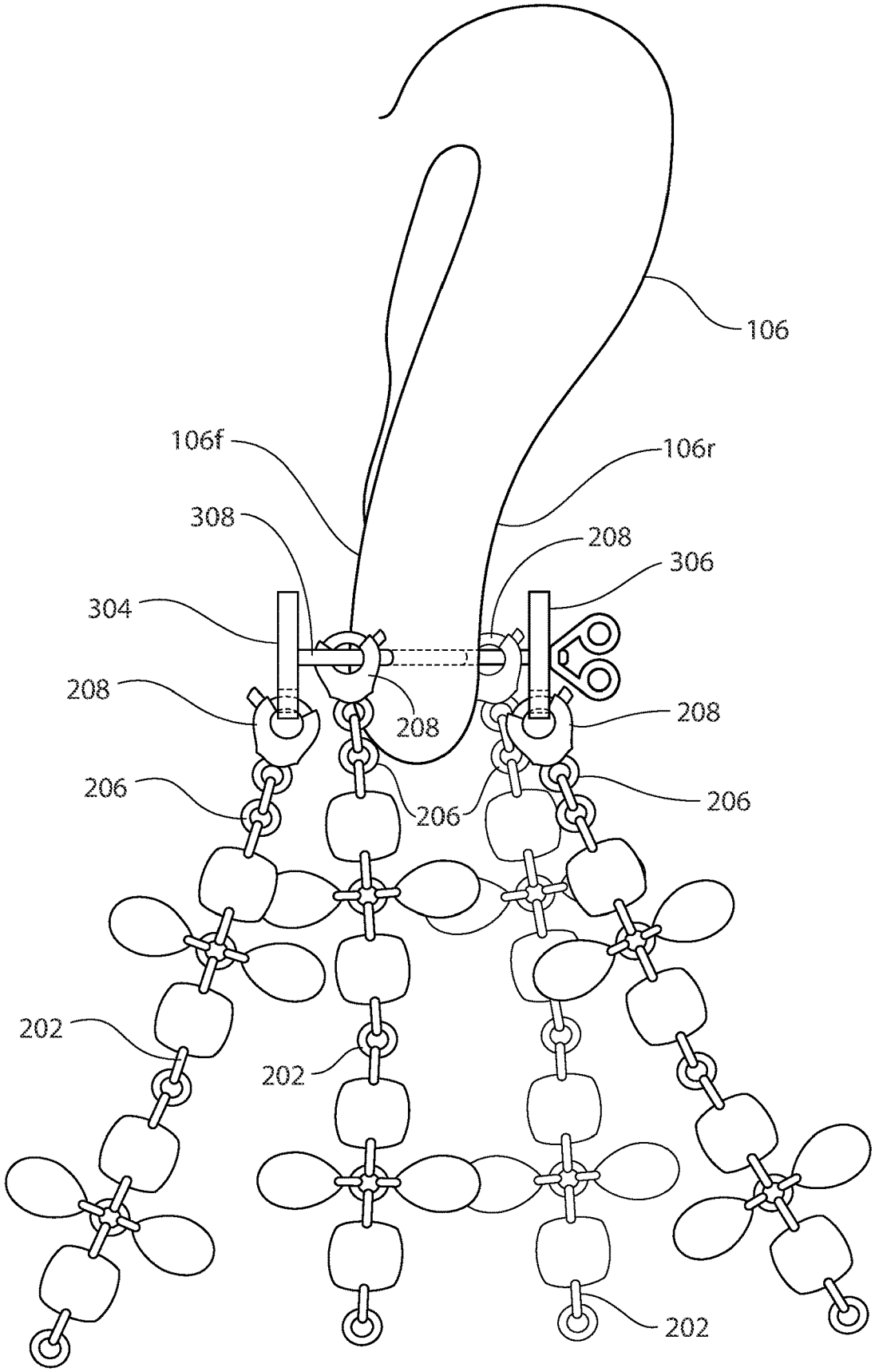
FIG. 13 illustrates an embodiment of a plurality of modalities of selective securement and selective unsecurement of a plurality of end portions of a plurality of lines according to various principles of this disclosure.

FIG. 13 illustrates an embodiment of a plurality of modalities of selective securement and selective unsecurement of a plurality of end portions of a plurality of lines according to various principles of this disclosure. In particular, the ear 106 includes a front side 106*f* and an rear (obverse) side 106*r*. The individual earring 302 includes the frontal piece 304, the backing 306, and a post 308 extending (e.g., spanning) between the frontal piece 304 and the backing 306. For example, the connector 208 can be respectfully selectively secured to or selectively unsecured from the individual earring 302 via the frontal piece 304, the post 308, or the backing 306. Therefore, as illustrated in FIG. 13, the connector 208 is embodied as a clasp (e.g., a lobster clasp, a ring clasp). As such, the clasp can selectively secure to or selectively unsecure from the individual earring 302 via clasping or unclasping onto the frontal piece 304, the post 308, or the backing 306. For example, the clasp can clasp onto the post 308 such the clasp can be positioned between the frontal piece 304 and the front side 106*f*. The clasp can clasp onto the post 308 such that the clasp can be positioned between the backing 306 and the rear side 106*r*. Resultantly, the end portion 206 could be selectively secured to the individual earring 203, either in front of the ear 106 (e.g., exposed to the front side 106*f*) or behind the ear 106 (e.g., exposed to the rear side 106*r*).

As disclosed herein, note that the clasp is one of various types of connectors 208 that can be used, whether of identical or not identical to each other in terms of structure, properties (e.g., geometry, materials), or modality of operation. Further, note that the frontal piece 304, the post 308, or the backing 306 are sufficiently durable and lightweight to hold the line 200 or multiple lines 200 extending between the pair of earrings 300, yet simultaneously not hurt or not cause pain the wearer 100 by pulling down on one of the ears 106 or the pair of ears 106. Note that the individual earing 302 may be of another configuration. For example, the individual earring 302 may be a clip-on having a front wing and a back wing, where the front wing and the back wing are elastically pivoted to each other to secure to the ear 106 or magnetically attracted to each other to secure to the ear 106 extending (e.g., interposing) therebetween. As such, the connector 208 can selectively secure to or selectively unsecure from the front wing or the back wing, as disclosed herein.

FIG. 14 shows the line 200 extending (e.g., spanning, suspending, selectively securing) from the pair of earrings 300 over the over at least one of the back neck portion 128, the shoulder portion, or the upper back portion 130 based on the elongated portion 202 arcuately, parabolically, hyperbolically, or gravitationally spanning between the pair of earrings 300, as disclosed in FIGS. 1-13. In contrast, FIG. 15 shows the line 200 extending (e.g., span, suspend, selectively secure) from the pair of earrings 300 over the front chest area 120 underneath the chin 118 based on the elongated portion 202 arcuately, parabolically, hyperbolically, or gravitationally spanning between the pair of earrings 300, as disclosed in FIGS. 1-13.

FIG. 16 to FIG. 19 illustrates an embodiment of a method of selectively securing an end portion of a line to an earring worn on an ear of a wearer according to various principles of this disclosure. In particular, the wearer 100 operates the pair of hands 116 to remove the backing 306 from the post 308, while the post 308 extends through its respective ear 106. Then, the wearer 100 operates the pair of hands 116 to guide the end portion 206 such that the connector 208, which is embodied as a jump ring, is mounted onto the post 308 facing the rear side 106*r* and the post 308 extends through the connector 208, while the post 308 extends through its respective ear 106. Then, the wearer 100 operates the pair of hands 116 such that the backing 306 is mounted back onto the post 308 such that the connector 208 is positioned between the rear side 106*r* and the backing 306, while the post 308 extends through its respective ear 106. Note that although the wearer 100 operates the pair of hands 116 to selectively secure the connector 208 to the individual earring 302, this is not required. For example, another person or a robot (e.g., via an end effector of a robotic arm) may selectively secure the connector 208 to the individual earring 302, while the post 308 extends through its respective ear 106, or selectively unsure the connector 208 from the individual earring 302, while the post 308 extends through its respective ear 106. This may apply to all forms of selective securement or selective unsecurement, as disclosed herein. If the wearer 100 wants to remove the connector 208 from the post 308, while the post 308 extends through its respective ear 106, then this process may be reversed, as disclosed herein.

FIG. 20 to FIG. 23 illustrates an embodiment of a method of selectively securing an end portion of a line to an earring worn on an ear of a wearer according to various principles of this disclosure. In particular, the wearer operates the pair of hands 116 to remove the frontal piece 304 from the post 308, while the post 308 extends through its respective ear 106. Then, the wearer 100 operates the pair of hands 116 to guide the end portion 206 such that the connector 208, which is embodied as a jump ring, is mounted onto the post 308 facing the front side 106*f* and the post 308 extends through the connector 208, while the post 308 extends through its respective ear 106. Then, the wearer 100 operates the pair of hands 116 such that the frontal piece 305 is mounted back onto the post 308 such that the connector 208 is positioned between the frontal piece 304 and the front side 106*f*, while the post 308 extends through its respective ear 106. Note that although the wearer 100 operates the pair of hands 116 to selectively secure the connector 208 to the individual earring 302, this is not required. For example, another person or a robot (e.g., via an end effector of a robotic arm) may selectively secure the connector 208 to the individual earring 302, while the post 308 extends through its respective ear 106, or selectively unsure the connector 208 from the individual earring 302, while the post 308 extends through its respective ear 106. This may apply to all forms of selective securement or selective unsecurement, as disclosed herein. If the wearer 100 wants to remove the connector 208 from the post 308, while the post 308 extends through its respective ear 106, then this process may be reversed, as disclosed herein.

Figure 11:
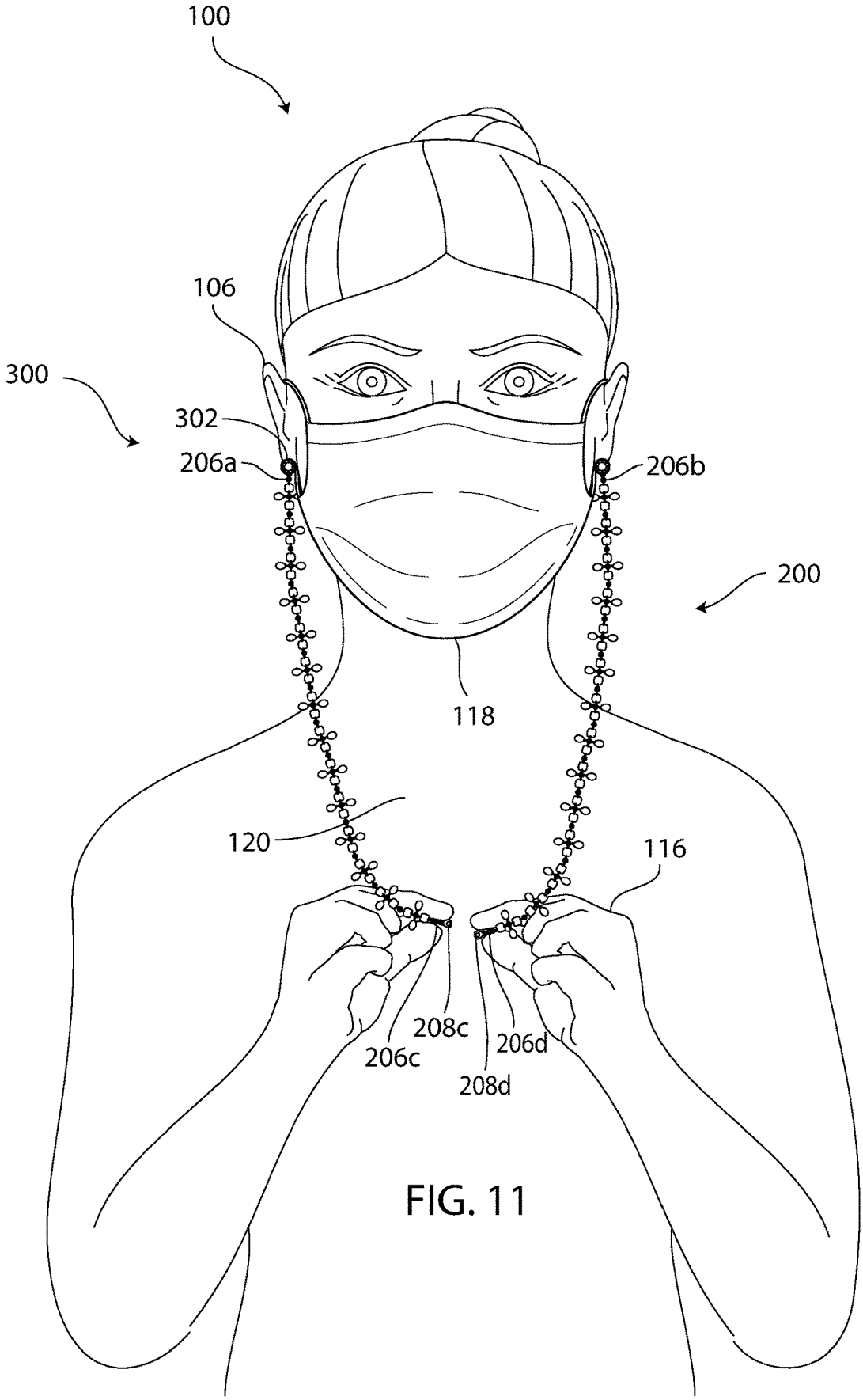
FIG. 11 illustrates an embodiment of a line extending from a pair of earrings worn on a pair of ears of a wearer where the line is formed by a pair of sub-lines (or elongated portions) that are selectively secured to each other according to various principles of this disclosure.
Figure 12:
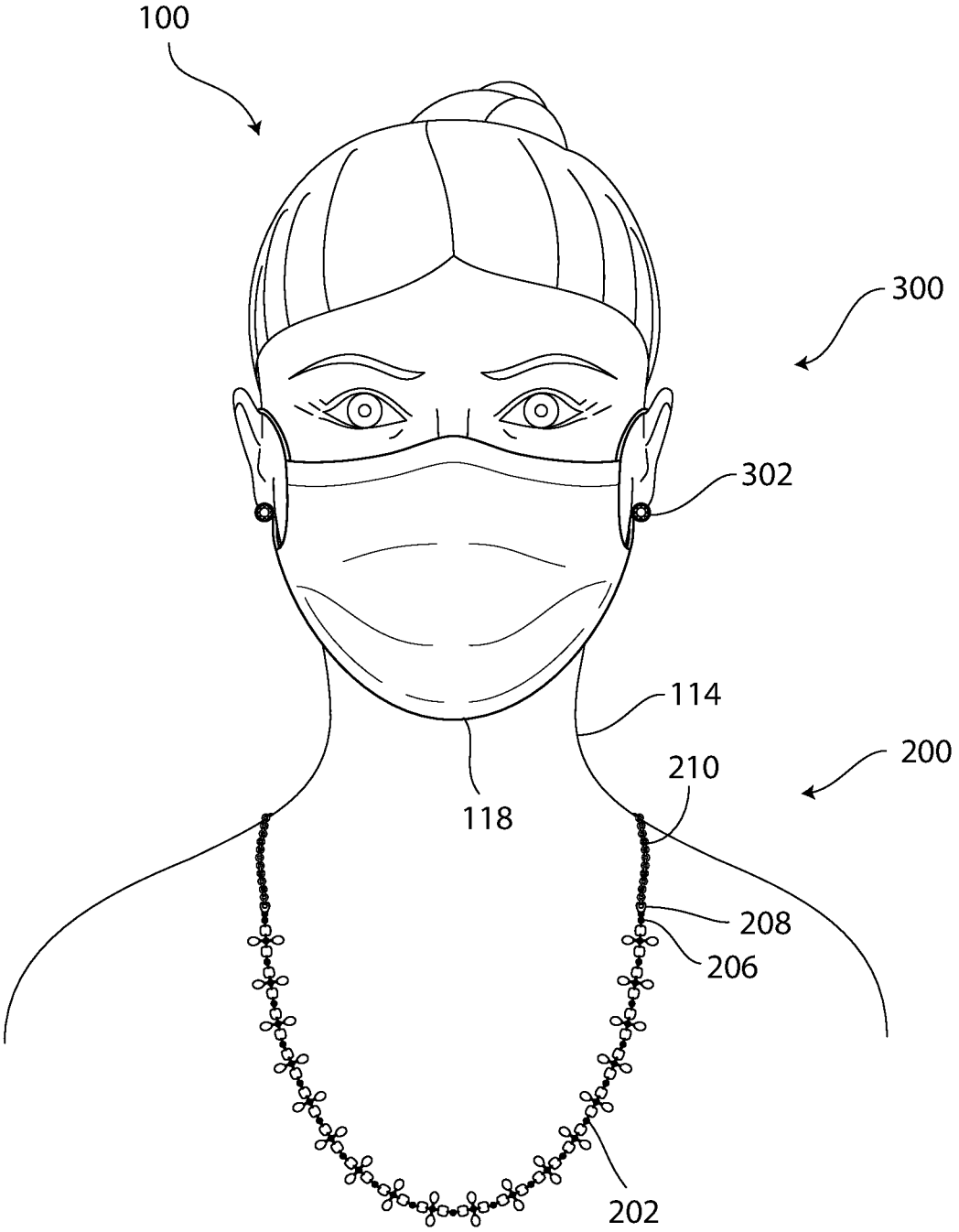
FIG. 12 illustrates an embodiment of a line being selectively unsecured from a pair of earrings worn on a pair of ears of a wearer and the line being extended with an extender and worn around a neck of the wearer according to various principles of this disclosure.

FIG. 11 illustrates an embodiment of a line extending from a pair of earrings worn on a pair of ears of a wearer where the necklace is formed by a pair of sub-lines (or elongated portions) that are selectively secured to each other according to various principles of this disclosure. FIG. 12 illustrates an embodiment of a line being selectively unsecured from a pair of earrings worn on a pair of ears of a wearer and the line being extended with an extended and worn around a neck of the wearer according to various principles of this disclosure. The line 200 can be or can avoid being modular, reusable, or extendable. In particular, the line 200 can be a single line 200, illustrated in FIGS. 1, 2, 4, 5, 7, 14, 15. Likewise, the line 200 can be a set of lines, as illustrated in FIGS. 3, 6, 8-10, 11, 13.

As illustrated in FIG. 11, the line 200 can be selectively elongated by consecutively attaching other elongated portions 202, whether aesthetically identical or not identical to preexisting elongated portion 202, or selectively shortened by removing desired elongated portions 202 already worn as the line 202 between the pair of earrings 300. While the end portions 206*a* and 206*b* are respectfully extending from the individual earrings 302, whether permanently attached therewith or selectively secured therewith, the elongated portion 202 each respectively include the end portions 206*c* and 208*c*, each respectively including the connectors 208*c* and 208*d* respectfully distal to the end portions 206*a* and 206*b*. The connectors 208*c* and 208*d* can selectively secure to each other or selectively unsecure from each other, as disclosed herein. For example, the connectors 208*c* and 208*d* can selectively secure (e.g., detachably attached, attachably detached, mounted, clasped, connected, fastened, mated, interlocked, magnetized, latched, grasped, hooked, hook-and-looped) to each other in one set of steps and selectively unsecure from each other in reversing that set of steps.

Note that although FIG. 13 illustrates the necklace 200 as having two elongated portions 202, this is not required and the line 200 can include more than two elongated portions 202 (e.g., three, four, five, six, seven or more as needed) selectively securing to or selectively unsecuring from each other, whether to selectively lengthen or selectively shorten the line 202. This selective lengthening or selectively shortening may be technologically beneficial for various reasons. For example, some of such reasons may include to vary how the line 200 appears (e.g., the wearer 100 self-decides on how long or short the line 200 is). For example, some of such reasons may include whether the line 200 needs to accommodate for the facial covering 110 or the hijab 122. For example, some of such reasons may include mounting another line 202 onto the elongated portion 202 (as currently present) extending between the pair of earrings 300. For example, some of such reasons may include if the wearer 100 desires to selectively mount to or loop on or selectively unmount from or loop off an object onto or from the elongated portion 202 between the individual earrings 302, without selectively unsecuring at least one end portion 206*a* or 206*b* from its respective earring 302 via its respective connector 208*a* or 208*b*, as disclosed herein. Note that the object can be secured to the elongated portion 202 between the individual earrings 302. The object may include a housing. The housing may contain or host a capacitor or a battery, which may be rechargeable. The object may contain or host an electrical load powered by the capacitor or the battery. For example, the load may include a microphone (or another input or output device) powered by the capacitor or the battery. For example, the object may be a charm or a pendant.

As shown in FIG. 11, the wearer 100 may respectfully extend the pair of elongated portions 202*a* and 202*b* from the pair of earrings 300, as disclosed herein. The pair of elongated portions 202*a* and 202*b* are extended such that a pair of free end portions (206*c* and 208*c*) of the pair of elongated portions 202*a* and 202*b* can be selectively secured to each other such that the line 202 spans arcuately, parabolically, hyperbolically, or gravitationally between the pair of earrings 300. Likewise, the wearer 100 may selectively unsecure the pair of free end portions (206*c* and 208*c*) from each other such that the line 200 does not span arcuately, parabolically, hyperbolically, or gravitationally between the pair of earrings 300. This configuration can be included in a kit, whether the pair of elongated portions 202*a* and 202*b* are permanently attached to the pair of earrings 300 or detached from the pair of earrings 300 in the kit to be selectively secured to the pair of earrings 300 when the kit is opened and used.

As illustrated in FIG. 12, the line 200 can be worn around the neck 114, as is or if sufficiently configured (e.g., elongated). For example, the connectors 208*a* and 208*b* can selectively secure to or selectively unsecure from each other in order to enable the line 200 to be worn or taken off the neck 114. This may occur before the line 200 is selectively secured to the pair of earrings 300, as disclosed herein. This may occur after the line 200 is selectively unsecured from the pair of earrings 300, as disclosed herein.

As illustrated in FIG. 12, when the line 200 is insufficiently configured (e.g., elongated) to extend around the neck 114, the wearer 100 may use an extender 210 (e.g., another line) to extend the line 200. For example, the extender 210 can be another line 200, as disclosed herein, whether identical or non-identical thereto in terms of structure, properties (e.g., geometry, materials), or modality of operation. For example, the extender 210 can be a line, a chain, a braid, a rope, a string, a cable, or another elongated portion (or a set of elongated portions consecutively joined together to form the extender 210) having a pair of end portions (e.g., like the connectors 208) that can selectively secure (e.g., detachably attached, attachably detached, mounted, clasped, connected, fastened, mated, interlocked, magnetized, latched, grasped, hooked, hook-and-looped) to or selectively unsecure (reverse selective securing) from the pair of connectors 208. As such, the wearer 100 may selectively unsecure the line 200 from the pair of earrings 300 and wear the line 200 over the neck 114 (e.g., extend around the neck 114 as a necklace) after the line 200 is selectively unsecured from the pair of earrings 300. Likewise, the wearer 100 may remove (e.g., selectively unsecure) the line 200 from the neck 114 when the line 200 is worn on the neck 114 (e.g., extend around the neck 114 as a necklace) before the pair of end portions 206 extends from the pair of earrings 300 worn on the pair of ears 106 such that the line 200 arcuately, parabolically, hyperbolically, or gravitationally spans between the pair of ears 300.

FIG. 24A to FIG. 24H illustrate a plurality of embodiments of a plurality of lines extending from a plurality of components of a plurality of earrings according to this disclosure. In particular, the connector 208 may be embodied as a component of a respective individual earring 300. For example, the connector 208 can be structurally integral to a respective individual earring 302.

Figure 24A:
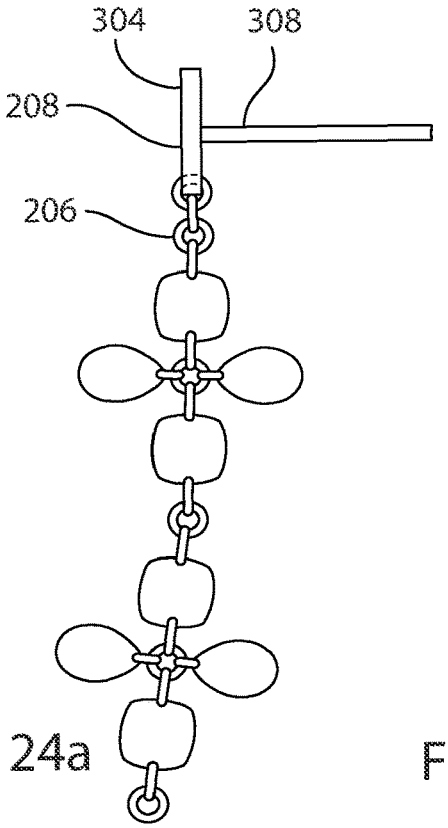
FIG. 24A to FIG. 24H illustrate a plurality of embodiments of a plurality of lines extending from a plurality of components of a plurality of earrings according to this disclosure.

FIG. 24A illustrates a respective connector 208 having a respective end portion 206 loop through (or otherwise permanently or selectively secure) a respective front piece 304 having a post extending (e.g., cantileveredly) therefrom. This way, in order to put on the respective individual earring 302, the wearer 100 can insert the post 308 through the ear 106 and then mount (or otherwise secure) the backing 306 thereon. Likewise, the wearer 100 may reverse this process to take off the individual earring 302. This can be mixed and matched with other embodiments, as disclosed herein.

Figure 24B:
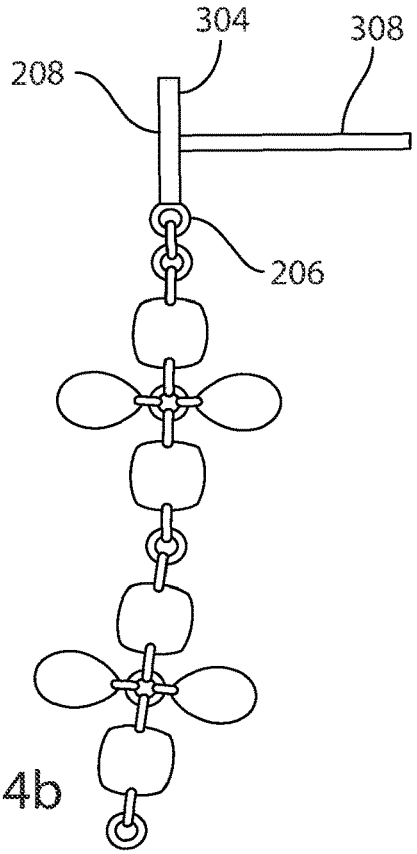

FIG. 24B illustrates a respective connector 208 having a respective end portion 206 avoid looping through a respective front piece 304 having a post extending (e.g., cantileveredly) therefrom. This avoidance may occur in various ways (e.g., soldered, molded, welded, chiseled, 3D printed, or otherwise permanently or selectively secure). This way, in order to put on the respective individual earring 302, the wearer 100 can insert the post 308 through the ear 106 and then mount (or otherwise secure) the backing 306 thereon. Likewise, the wearer 100 may reverse this process to take off the individual earring 302. This can be mixed and matched with other embodiments, as disclosed herein.

Figure 24C:
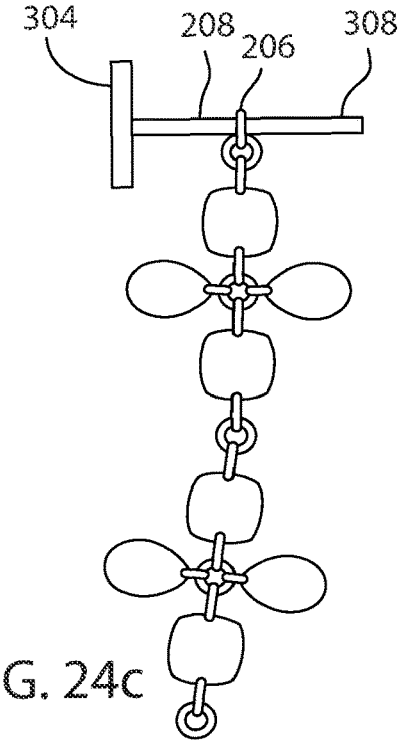

FIG. 24C illustrates a respective connector 208 having a respective end portion 206 looping around (or otherwise permanently or selectively secure) the post 308 extending (e.g., cantileveredly) from the frontal piece 304, although the post 308 can extend (e.g., cantileveredly) from the backing 306 as well. This way, in order to put on the respective individual earring 302, the wearer 100 can insert the post 308 through the ear 106, whether from the front side 106*f* or the rear side 106*r*, and then mount (or otherwise secure) the backing 306 thereon. Likewise, the wearer 100 may reverse this process to take off the individual earring 302. This can be mixed and matched with other embodiments, as disclosed herein. Note that the respective end portion can face the front side 106*f* or the rear side 106*r*.

Figure 24D:
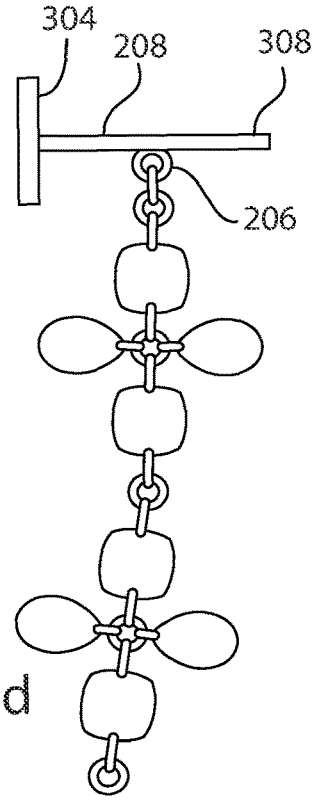

FIG. 24D illustrates a respective connector 208 having a respective end portion 206 avoiding looping around the post 308 extending (e.g., cantileveredly) from the frontal piece 304, although the post 308 can extend (e.g., cantileveredly) from the backing 306 as well. This avoidance may occur in various ways (e.g., soldered, molded, welded, chiseled, 3D printed, or otherwise permanently or selectively secure). This way, in order to put on the respective individual earring 302, the wearer 100 can insert the post 308 through the ear 106, whether from the front side 106*f* or the rear side 106*r*, and then mount (or otherwise secure) the backing 306 thereon. Likewise, the wearer 100 may reverse this process to take off the individual earring 302. This can be mixed and matched with other embodiments, as disclosed herein. Note that the respective end portion can face the front side 106*f* or the rear side 106*r*.

Figure 24E:
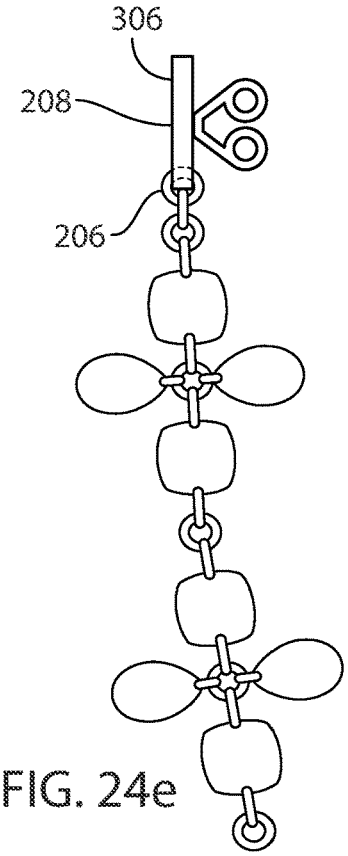

FIG. 24E illustrates a respective connector 208 having a respective end portion 206 loop through (or otherwise permanently or selectively secure) a respective backing 306, which can have or can avoid having a post extending (e.g., cantileveredly) therefrom. This way, in order to put on the respective individual earring 302, the wearer 100 can mount (or otherwise secure) the backing 306 onto the post 308 extending through the ear 106. Likewise, the wearer 100 may reverse this process to take off the individual earring 302. This can be mixed and matched with other embodiments, as disclosed herein.

Figure 24F:
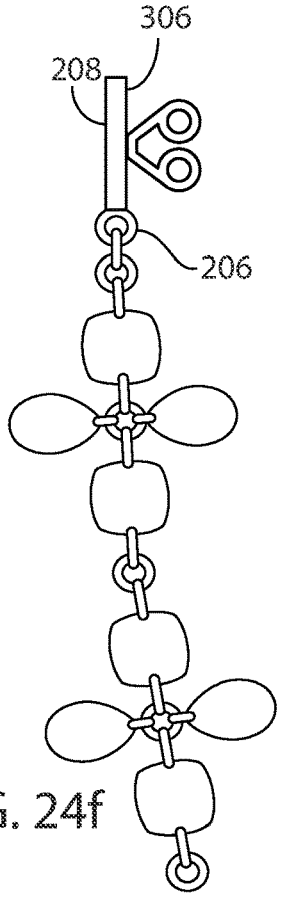

FIG. 24F illustrates a respective connector 208 having a respective end portion 206 avoid looping through (or otherwise permanently or selectively secure) a respective backing 306, which can have or can avoid having a post extending (e.g., cantileveredly) therefrom. This avoidance may occur in various ways (e.g., soldered, molded, welded, chiseled, 3D printed, or otherwise permanently or selectively secure). This way, in order to put on the respective individual earring 302, the wearer 100 can mount (or otherwise secure) the backing 306 onto the post 308 extending through the ear 106. Likewise, the wearer 100 may reverse this process to take off the individual earring 302. This can be mixed and matched with other embodiments, as disclosed herein.

Figure 24G:
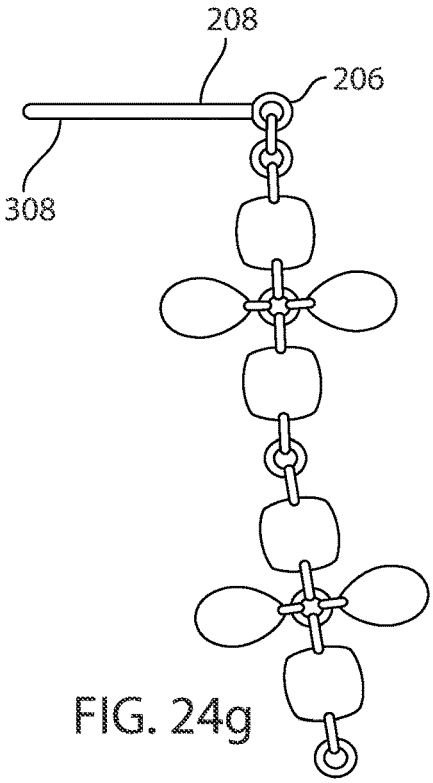
Figure 24H:
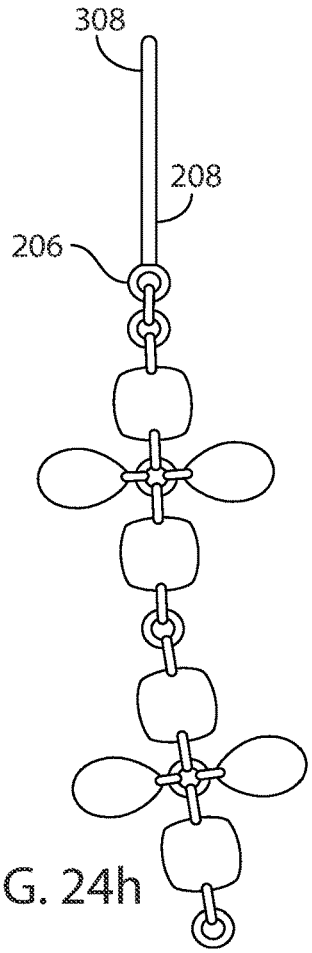

FIG. 24G illustrate a respective connector 208 having a respective end portion 206 include a respective post 308 which extends (e.g., cantileveredly) in a non-aligned manner (e.g., less than 180 degrees or greater than 0 degrees) with a respective line 202. The respective post 308 is monolithic with the respective end portion 206 (e.g., a ring of a chain). For example, the respective post 308 can be soldered, molded, welded, chiseled, 3D printed, or otherwise permanently or selectively secured to the respective end portion 206. For example, the respective post 308 can extend along a horizontal plane (e.g., into an ear lobe) into a respective ear 106 of the wearer 100. This can be mixed and matched with other embodiments, as disclosed herein In contrast, FIG. 24H shows illustrate the respective connector 208 having the respective end portion 206 include the respective post 308 which extends (e.g., cantileveredly) in an aligned manner (e.g., 180 degrees or 0 degrees) with the respective line 202. For example, the respective post 308 can extend along a vertical plane (e.g., a helix region, a conch region) into the respective ear 106 of the wearer 100. This can be mixed and matched with other embodiments, as disclosed herein.

Note that the line 200 may be packaged in a kit, alone or in combination with one individual earring 302 or the pair of earrings 300 or another jewelry item, as disclosed herein. For example, the kit can include a package (e.g., an envelope, a box, an intermodal container) containing the pair of earrings 300 (or another jewelry item) and the line 200. For example, the kit can include the pair of earrings 300 configured to be worn on the pair of ears 300. The kit can include the line 200 having the end portions 206 configured to selectively secure to the pair of earrings 300 when worn on the pair of ears 106, as disclosed herein, such that the line 200 arcuately, parabolically, hyperbolically, or gravitationally spans between the pair of earrings 300.

Various corresponding structures, materials, acts, and equivalents of all means or step plus function elements in various claims below are intended to include any structure, material, or act for performing the function in combination with other claimed elements as specifically claimed. Various embodiments were chosen and described in order to best disclose various principles of this disclosure and various practical applications thereof, and to enable others of ordinary skill in a pertinent art to understand this disclosure for various embodiments with various modifications as are suited to a particular use contemplated.

This detailed description has been presented for various purposes of illustration and description, but is not intended to be fully exhaustive or limited to this disclosure in various forms disclosed. Many modifications and variations in techniques and structures will be apparent to those of ordinary skill in an art without departing from a scope and spirit of this disclosure as set forth in various claims that follow. Accordingly, such modifications and variations are contemplated as being a part of this disclosure. Scope of this disclosure is defined by various claims, which include known equivalents and unforeseeable equivalents at a time of filing of this disclosure.

What is claimed is:

1. A method comprising:

causing a first end portion of a first line to extend from a first earring worn on a first ear of a wearer having a neck;

causing a second end portion of the first line to extend from a second earring worn on a second ear of the wearer such that the first line arcuately, parabolically, hyperbolically, or gravitationally spans between the first earring and the second earring;

causing the first end portion to be detached from the first earring;

causing the second end portion to be detached from the second earring; and causing the first end portion to be attached to a third end portion of a second line and the second end portion to be attached to a fourth end portion of the second line such that the first line and the second line collectively form a necklace around the neck.

2. The method of claim 1, wherein the first end portion or the second end portion is respectfully selectively secured to the first earring or the second earring.

3. The method of claim 2, wherein the first end portion or the second end portion respectfully includes a connector via which the first end portion or the second end portion is respectfully selectively secured to the first earring or the second earring.

4. The method of claim 3, wherein the connector is a jump ring.

5. The method of claim 3, wherein the connector is a clasp.

6. The method of claim 3, wherein the connector is not a jump ring and not a clasp.

7. The method of claim 2, wherein the first earring or the second earring includes a frontal piece, wherein the first end portion or the second end portion is respectfully selectively secured to the first earring or the second earring via the frontal piece.

8. The method of claim 2, wherein the first earring or the second earring includes a post, wherein the first end portion or the second end portion is respectfully selectively secured to the first earring or the second earring via the post.

9. The method of claim 2, wherein the first earring or the second earring includes a backing, wherein the first end portion or the second end portion is respectfully selectively secured to the first earring or the second earring via the backing.

10. The method of claim 1, wherein the first line has a first length and the second line has a second length, wherein the first length and the second length are not identical.

11. The method of claim 1, wherein the wearer has a chin, wherein the first line extends underneath the chin based on the first line arcuately, parabolically, hyperbolically, or gravitationally spanning between the first earring and the second earring before the first end portion or the second end portion being respectively detached from the first earring or the second earring.

12. The method of claim 1, wherein the wearer has a back neck portion of the neck, a shoulder portion, or an upper back portion, wherein the first line extends over the back neck portion, the shoulder portion, or the upper back portion based on the first line arcuately, parabolically, hyperbolically, or gravitationally spanning between the first earring and the second earring before the first end portion or the second end portion being respectively detached from the first earring or the second earring.

13. The method of claim 1, wherein the wearer wears a facial covering or a head covering having a facial opening through which the first line extends based on the first line arcuately, parabolically, hyperbolically, or gravitationally spanning between the first earring and the second earring before the first end portion or the second end portion being respectively detached from the first earring or the second earring.

14. The method of claim 13, wherein the facial covering or the head covering includes a hijab having the facial opening.

15. The method of claim 1, wherein the first ear or the second ear respectfully includes a lobe, wherein the first earring or the second earring is respectfully worn on the lobe while the first line arcuately, parabolically, hyperbolically, or gravitationally spans between the first earring and the second earring.

16. The method of claim 1, wherein the first ear or the second ear respectfully includes an area, wherein the first earring or the second earring is respectfully worn on the area while the first line arcuately, parabolically, hyperbolically, or gravitationally spans between the first earring and the second earring, wherein the area is not a lobe.

17. The method of claim 1, wherein the first line is a single line.

18. The method of claim 1, wherein the first line is at least two lines consecutively attached to each other thereby forming the first line.

19. The method of claim 1, further comprising:

causing an object to be secured to the first line between the first earring and the second earring while the first line arcuately, parabolically, hyperbolically, or gravitationally spans between the first earring and the second earring.

20. The method of claim 1, wherein the first earring and the second earring are respectfully worn in a pair of same regions of the first ear and the second ear while the first line arcuately, parabolically, hyperbolically, or gravitationally spans between the first earring and the second earring.

21. The method of claim 1, wherein the first earring and the second earring are respectfully worn in a pair of non-same regions of the first ear and the second ear while the first line arcuately, parabolically, hyperbolically, or gravitationally spans between the first earring and the second earring.

22. A method comprising:

causing a first end portion of a line to extend from a first earring worn on a first ear of a wearer wearing a facial covering or a head covering having a facial opening; and causing a second end portion of the line to extend from a second earring worn on a second ear of the wearer such that the line (a) arcuately, parabolically, hyperbolically, or gravitationally spans between the first earring and the second earring and (b) extends through the facial opening based on the line arcuately, parabolically, hyperbolically, or gravitationally spanning between the first earring and the second earring.

23. The method of claim 22, wherein the facial covering or the head covering includes a hijab having the facial opening.

24. The method of claim 22, wherein the first end portion or the second end portion is respectfully selectively secured to the first earring or the second earring.

25. The method of claim 24, wherein the first end portion or the second end portion respectfully includes a connector via which the first end portion or the second end portion is respectfully selectively secured to the first earring or the second earring.

26. The method of claim 25, wherein the connector is not a jump ring and not a clasp.

27. The method of claim 22, wherein the line is a first line, and further comprising:

causing a second line to extend through the facial opening based on the second line arcuately, parabolically, hyperbolically, or gravitationally extending along the first line.

28. The method of claim 27, wherein the second line includes a third end portion extending from the first line while the first line (a) arcuately, parabolically, hyperbolically, or gravitationally spans between the first earring and the second earring and (b) extends through the facial opening based on the first line arcuately, parabolically, hyperbolically, or gravitationally spanning between the first earring and the second earring.

29. The method of claim 27, wherein the second line includes a third end portion extending from the first earring worn on the first ear or the second earring worn on the second ear while the first line (a) arcuately, parabolically, hyperbolically, or gravitationally spans between the first earring and the second earring and (b) extends through the facial opening based on the first line arcuately, parabolically, hyperbolically, or gravitationally spanning between the first earring and the second earring.

30. A method comprising:

causing a first end portion of a line to extend from a first earring worn on a first non-lobe portion of a first ear of a wearer, wherein the first earring includes (a) a first post extending through the first non-lobe portion or (b) a first pair of clip-on wings clipping onto the first non-lobe portion; and causing a second end portion of the line to extend from a second earring worn on a second non-lobe portion of a second ear of the wearer such that the line arcuately, parabolically, hyperbolically, or gravitationally spans between the first earring and the second earring, wherein the second earring includes (a) a second post extending through the second non-lobe portion or (b) a second pair of clip-on wings clipping onto the second non-lobe portion.

* * * * *